US008939534B2

(12) United States Patent
Miyazaki et al.

(10) Patent No.: US 8,939,534 B2
(45) Date of Patent: Jan. 27, 2015

(54) LIQUID EJECTION APPARATUS

(75) Inventors: Shinichi Miyazaki, Suwa (JP); Kunio Tabata, Shiojiri (JP); Atsushi Oshima, Shiojiri (JP); Hiroyuki Yoshino, Matsumoto (JP); Noritaka Ide, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 221 days.

(21) Appl. No.: 12/905,638

(22) Filed: Oct. 15, 2010

(65) Prior Publication Data

US 2011/0090273 A1 Apr. 21, 2011

(30) Foreign Application Priority Data

Oct. 16, 2009 (JP) ..... 2009-238989

(51) Int. Cl.
*B41J 29/38* (2006.01)
*B41J 2/045* (2006.01)

(52) U.S. Cl.
CPC ..... *B41J 2/04591* (2013.01); *B41J 2/04553* (2013.01); *B41J 2/0456* (2013.01); *B41J 2/04581* (2013.01); *B41J 2/0459* (2013.01)
USPC ..... 347/14

(58) Field of Classification Search
USPC ..... 347/14, 11, 17, 19
See application file for complete search history.

(56) References Cited

U.S. PATENT DOCUMENTS

| | | | | |
|---|---|---|---|---|
| 5,264,865 | A | 11/1993 | Shimoda et al. | |
| 6,799,824 | B2 * | 10/2004 | Nunokawa | 347/15 |
| 7,049,756 | B2 | 5/2006 | Aiba et al. | |

FOREIGN PATENT DOCUMENTS

| | | |
|---|---|---|
| EP | 0864425 A1 | 9/1998 |
| JP | 06-040032 | 2/1994 |
| JP | 08-156248 | 6/1996 |
| JP | 2002-205397 | 7/2002 |
| JP | 2003-285441 | 10/2003 |

OTHER PUBLICATIONS

European Search Report mailed Feb. 25, 2011 as received in related European Application No. 10187535.9.

* cited by examiner

*Primary Examiner* — Julian Huffman
(74) *Attorney, Agent, or Firm* — Maschoff Brennan

(57) ABSTRACT

A liquid ejection apparatus which, by applying a drive voltage waveform to a piezoelectric element which drives an ejection nozzle, ejects a liquid from the ejection nozzle. The apparatus includes a reference voltage generating unit which generates a plurality of reference voltages, a drive voltage waveform data storage unit classifies the drive voltage waveform as either a voltage increasing section, decreasing section, or holding section, and stores drive voltage waveform data including a required time of a waveform section configuring the drive voltage waveform, and a voltage, selected from the plurality of reference voltages for the waveform section. The apparatus also includes a drive voltage waveform application unit which, in accordance with information relating to an adjustment of the ejection amount of the liquid ejected from the ejection nozzle, changes the required time included in the drive voltage waveform data, and applies the drive voltage waveform to the piezoelectric element.

10 Claims, 18 Drawing Sheets

| SERIAL NUMBER | DIS-CHARGE WEIGHT | LS (STAGES) | ---- | L0 (STAGES) | ---- | L1 (STAGES) | ---- | L2 (STAGES) | ---- | L3 (STAGES) | ---- | L4 (STAGES) | ---- | L5 (STAGES) |
|---|---|---|---|---|---|---|---|---|---|---|---|---|---|---|
| | | ---- | T0 (μs) | ---- | T1 (μs) | ---- | T2 (μs) | ---- | T3 (μs) | ---- | T4 (μs) | ---- | T5 (μs) | ---- |
| 1 | 8.0 | 2 | 2.0 | 2 | 4.5 | 4 | 2.5 | 4 | 2.4 | 0 | 5.0 | 0 | 2.0 | 2 |
| 2 | 8.2 | 2 | 2.0 | 2 | 4.5 | 4 | 2.5 | 4 | 2.1 | 0 | 5.0 | 0 | 2.0 | 2 |
| 3 | 8.4 | 2 | 2.0 | 2 | 4.5 | 4 | 2.5 | 4 | 1.7 | 0 | 5.0 | 0 | 2.0 | 2 |
| 4 | 8.6 | 2 | 2.0 | 2 | 4.5 | 4 | 2.5 | 4 | 1.3 | 0 | 5.0 | 0 | 2.0 | 2 |
| 5 | 8.8 | 2 | 2.0 | 2 | 4.5 | 4 | 2.5 | 5 | 3.0 | 0 | 5.0 | 0 | 2.0 | 2 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 14 | 10.6 | 2 | 2.0 | 2 | 4.5 | 6 | 2.5 | 6 | 2.3 | 0 | 5.0 | 0 | 2.0 | 2 |
| 15 | 10.8 | 2 | 2.0 | 2 | 4.5 | 6 | 2.5 | 6 | 1.9 | 0 | 5.0 | 0 | 2.0 | 2 |
| 16 | 11.0 | 2 | 2.0 | 2 | 4.5 | 6 | 2.5 | 6 | 1.5 | 0 | 5.0 | 0 | 2.0 | 2 |

$$Tx = \frac{Tn}{Ln - Ln-1}$$

LIQUID EJECTION APPARATUS

The entire disclosures of Japanese Patent Application No. 2009-238989, filed Oct. 16, 2009 is expressly incorporated herein by reference.

BACKGROUND OF THE INVENTION

1. Technical Field

The present invention relates to a technology of ejecting a liquid from an ejection nozzle.

2. Related Art

A liquid ejection apparatus which ejects a liquid, such as ink, using an ejection nozzle is widely known. Although a number of methods exist for ejecting a liquid from an ejection nozzle, as a typical example, a method is widely used whereby a piezoelectric element mounted on an ejection nozzle acts as an actuator, causing a droplet-like liquid to be ejected from the ejection nozzle by applying a predetermined voltage waveform to the piezoelectric element. Using this method, by changing the voltage waveform applied, it is possible to change the size of a droplet or a liquid ejection amount.

The piezoelectric element, as it is a capacitive load, has the property that, when a voltage is applied to the piezoelectric element, an electric charge is accumulated in the piezoelectric element and a voltage equivalent to the amount of electric charge accumulated appears as an applied voltage between the terminals of the piezoelectric element. For this reason, an electric charge has to be supplied to the piezoelectric element in order to increase the applied voltage, while an electric charge must be emitted from the piezoelectric element in order to decrease the applied voltage.

In order to drive the capacitive load at a high power efficiency, the following kind of technology is proposed. Firstly, a plurality of capacitors are charged by differing voltages. When increasing the applied voltage, an electric charge is supplied to the load by individually switching the capacitors to be connected to the capacitive load to higher voltage capacitors. When decreasing the applied voltage, by individually switching the capacitors to lower voltage capacitors, the electric charge of the capacitive load is recovered by the capacitors. By so doing, it is possible, when increasing the applied voltage again, to supply the capacitive load again with the electric charge recovered by the capacitors when decreasing the applied voltage, and increase the applied voltage, meaning that it is possible to drive the capacitive load at a high efficiency (JP-A-2003-285441).

However, in a case in which the piezoelectric element mounted on the ejection nozzle of the liquid ejection apparatus is driven by applying the technology of JP-A-2003-285441, there is a problem in that it is difficult to adjust the ejection amount of a liquid ejected from the ejection nozzle. That is, because the liquid ejection amount is based on the drive amount of the piezoelectric element, the ejection amount depends heavily on the maximum voltage or minimum voltage of a voltage waveform to be applied, but either a maximum voltage or minimum voltage is applied by connecting a capacitor which has been previously charged by the applied voltage to the piezoelectric element. Consequently, the voltage of the capacitor has to be changed in order to change the maximum voltage or minimum voltage of the voltage waveform. However, in the event that the voltage of the capacitor has been changed, when attempting to apply another voltage waveform, the maximum voltage and minimum voltage of the other voltage waveform also changes.

Of course, it is ideal that the voltage of the capacitor is changed for every voltage waveform, but as the capacitor is set to a large capacitance so that a stable voltage waveform can be output, it is not easy to change the voltage of the capacitor in the short time in which a voltage waveform switches. It is also conceivable, rather than using all the capacitors, to leave out, for example, a maximum voltage capacitor or a minimum voltage capacitor, and to connect the maximum voltage capacitor or minimum voltage capacitor to the piezoelectric element only when applying a higher voltage or a lower voltage, but with this configuration, the maximum voltage or minimum voltage of a voltage waveform fluctuates greatly, and the liquid ejection amount cannot be adjusted finely.

BRIEF SUMMARY OF THE INVENTION

An advantage of some aspects of the invention is to provide a technology capable of adjusting a liquid ejection amount while ejecting a liquid by switching a plurality of voltages, and connecting them to a piezoelectric element which drives an ejection nozzle.

A liquid ejection apparatus according to a first aspect of the invention applies a drive voltage waveform to a piezoelectric element which drives an ejection nozzle, ejects a liquid from the ejection nozzle, includes a reference voltage generating unit which generates a plurality of reference voltages, a drive voltage waveform data storage unit which, classifies the drive voltage waveform as a waveform section comprising either a voltage increasing section, decreasing section, or holding section, stores drive voltage waveform data including a required time of a waveform section configuring the drive voltage waveform, and a voltage, selected from the plurality of reference voltages, at boundary positions of the waveform section, and a drive voltage waveform application unit which, in accordance with information relating to an adjustment of the ejection amount of the liquid ejected from the ejection nozzle, changes the required time included in the drive voltage waveform data, and applies the drive voltage waveform to the piezoelectric element.

With the liquid ejection apparatus of the aspect of the invention, the liquid is ejected from the ejection nozzle by connecting the plurality of reference voltages to the piezoelectric element while switching them in accordance with the drive voltage waveform data. Required times of a plurality of waveform sections configuring the drive voltage waveform, and voltages in the boundary positions of the waveform sections, are stored in the drive voltage waveform data. When applying a drive voltage waveform to the piezoelectric element, a required time of a waveform section included in the drive voltage waveform data is changed in accordance with the information relating to the adjustment of the ejection amount of the liquid. Of course, depending on acquired information, it may also happen that the drive voltage waveform data are not changed. The liquid is ejected by applying the drive voltage waveform in accordance with the drive voltage waveform data obtained in this way.

As the liquid is ejected by the piezoelectric element deforming, the ejection amount of the liquid depends heavily on the amplitude of a drive voltage waveform applied to the piezoelectric element. In the case of applying a drive voltage waveform to the piezoelectric element by switching the preset plurality of reference voltages and connecting them to the piezoelectric element, it is not easy to finely change the amplitude of the drive voltage waveform. However, the ejection amount of the liquid also depends partially on the required time of the waveform section configuring the drive voltage waveform. Consequently, by changing the required time of the waveform section configuring the drive voltage waveform, it is possible to finely adjust the ejection amount of the liquid ejected from the ejection nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, in order to clarify the heretofore described details of the invention, an embodiment will be described in accordance with the following sequence.

A. Apparatus Configuration
B. Configuration of Ejection Head
B-1. Configuration of Ejection Nozzle Drive Circuit
B-2. Drive Voltage Waveform Generating Method
C. Ejection Amount (Discharge Weight) Adjusting Method
D. Ejection Nozzle Drive Process
E. Modification Examples
E-1. Second embodiment
E-2. Third embodiment
E-3. Fourth embodiment
E-4. Fifth embodiment
E-5. Sixth embodiment

A. Apparatus Configuration

Figure 1:
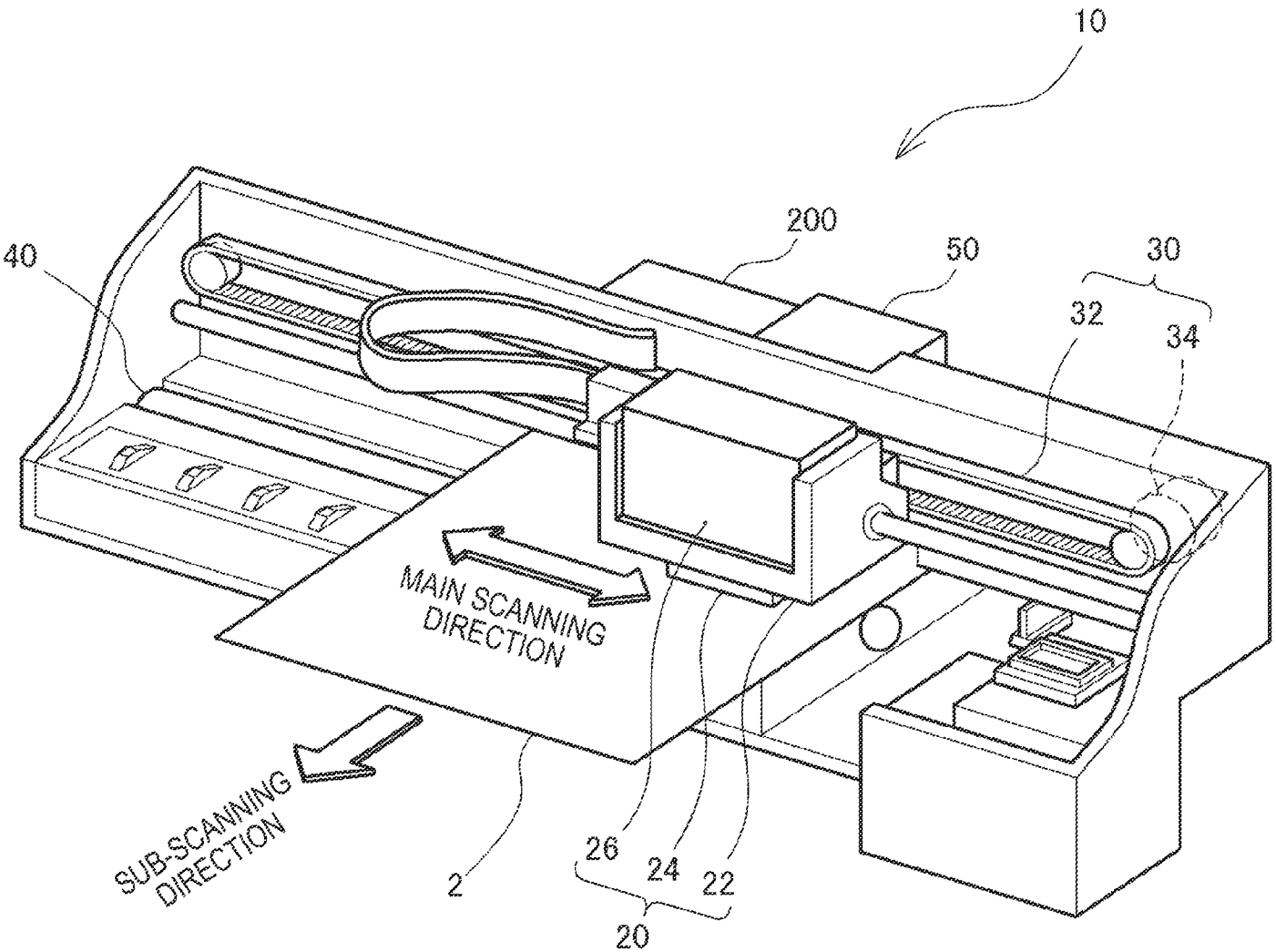
FIG. 1 is an illustration illustrating an inkjet printer acting as a liquid ejection apparatus which is capable of performing aspects of the invention in one embodiment.

FIG. 1 is an illustration illustrating an inkjet printer 10 as an example of a liquid ejection apparatus capable of performing aspects of the invention. The inkjet printer 10 shown in the diagram is configured of a carriage 20 which forms ink dots on a printing medium 2 while reciprocating in a main scanning direction, a drive mechanism 30 which reciprocates the carriage 20, a platen roller 40 for carrying out a feed of the printing medium 2, and the like. The carriage 20 is provided with an ink cartridge 26 storing ink therein, a carriage case 22 in which the ink cartridge 26 is mounted, an ejection head 24 mounted on the bottom surface side (the side which faces the printing medium 2) of the carriage case 22, and the like. A plurality of ejection nozzles are provided in the ejection head 24, as will be described hereafter. The ejection head 24 is mounted on the ink cartridge 26 in the carriage case 22. The ink in the ink cartridge 26 is led to the ejection head 24, thus enabling the ink to be ejected from the ejection nozzles toward the printing medium 2.

The drive mechanism 30 which reciprocates the carriage 20 is configured of a timing belt 32 stretched by pulleys, a step motor 34 which drives the timing belt 32 via the pulleys, and the like. One portion of the timing belt 32 is fixed to the carriage case 22, making it is possible to reciprocate the carriage case 22 by driving the timing belt 32. The platen roller 40, configuring a paper feed mechanism which carries out a feed of the printing medium 2, together with an drive motor (not shown) and gear mechanism, feed the printing medium 2 in a sub-scanning direction by a predetermined amount at a time.

A printer control circuit 50 which controls an overall operation and an ejection nozzle drive circuit 200 for driving the ejection nozzles provided in the ejection head 24 are also mounted on the inkjet printer 10. The ejection nozzle drive circuit 200, drive mechanism 30, paper feed mechanism, and the like, drive the ejection nozzles, and eject ink while feeding the printing medium 2 under the control of the printer control circuit 50, thereby printing an image on the printing medium 2.

B. Configuration of Ejection Head

Figure 2:
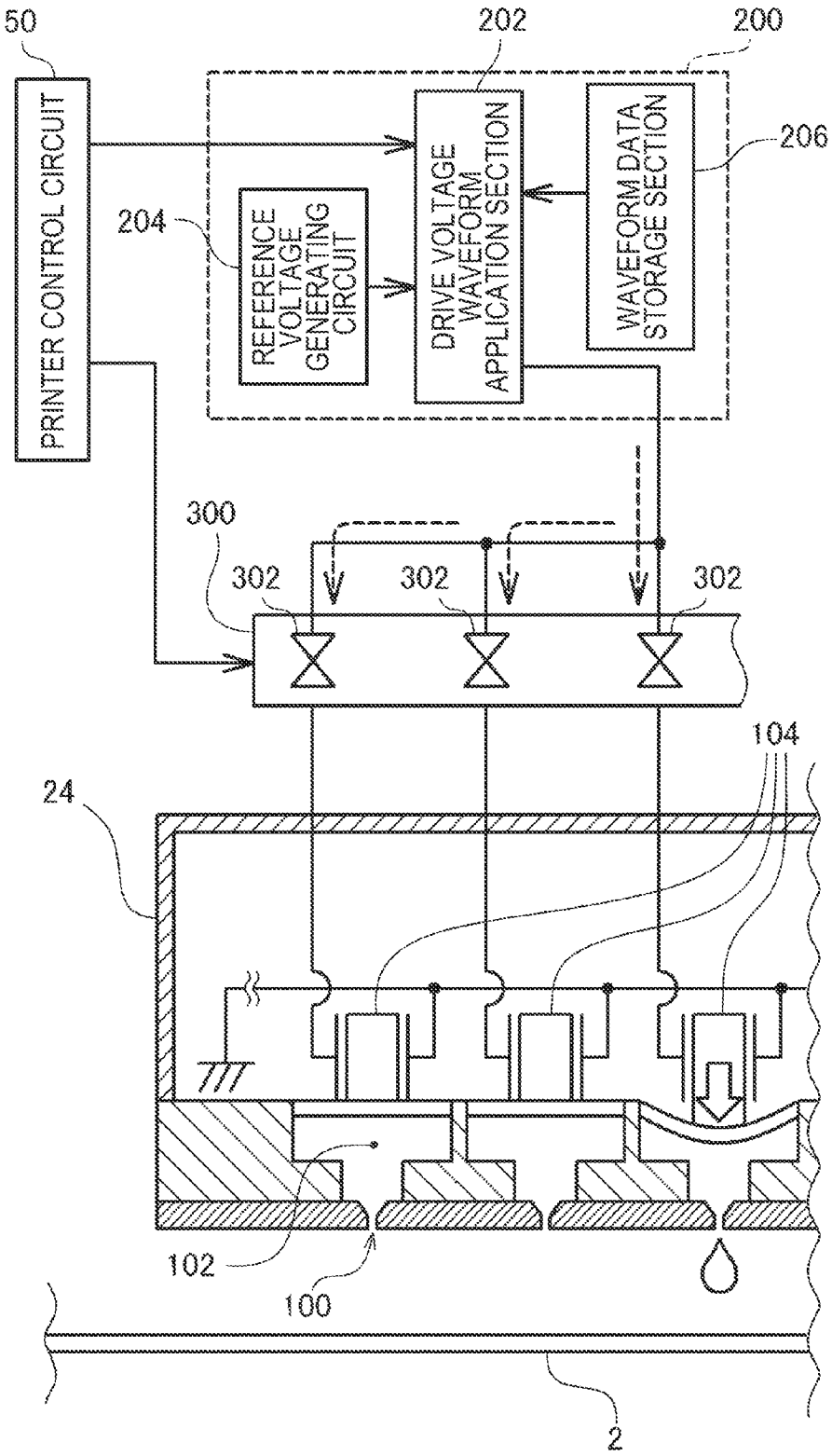
FIG. 2 is an illustration showing a configuration of an ejection head and a circuit configuration for driving a plurality of ejection nozzles provided in the ejection head.

FIG. 2 is an illustration showing a configuration of the ejection head 24, and a circuit configuration for driving the plurality of ejection nozzles 100 provided in the ejection head 24. As shown in the diagram, the plurality of ejection nozzles 100 are provided on the bottom surface side of the ejection head 24. An ink chamber 102 is formed for each ejection nozzle 100 and ink is supplied to the ink chamber 102 from the ink cartridge 26. A piezoelectric element 104 is provided on the upper surface of each ink chamber 102. For this reason, when a voltage is applied to the piezoelectric element 104 to deform the piezoelectric element, ink in the ink chamber 102 is pressurized, and ejected in a droplet form from the ejection nozzle 100. The deformation amount of the piezoelectric element 104 is controlled by controlling the waveform applied to the piezoelectric element 104, such that an ink droplet of an appropriate size is ejected at an appropriate timing.

After being generated by the ejection nozzle drive circuit 200 under the control of the printer control circuit 50, a drive voltage waveform is supplied to the piezoelectric element 104 via a gate unit 300. The gate unit 300 is a circuit unit wherein a plurality of gate elements 302 are connected in parallel, and the gate elements 302 can be individually put into a conducting condition or a cut-off condition under a control from the printer control circuit 50. Consequently, after a gate element 302 has been preset to either the conducting condition or cut-off condition by the printer control circuit 50, by outputting a drive voltage waveform from the ejection nozzle drive circuit 200, the drive voltage waveform, passing through only the gate element 302 preset to the conducting condition, is applied to a corresponding piezoelectric element 104, thus enabling an ink droplet to be ejected from its nozzle.

As shown in FIG. 2, the ejection nozzle drive circuit 200 of the embodiment is configured of a drive voltage waveform application section 202 which generates a drive voltage waveform and applies it to the ejection nozzle 100, a reference voltage generating circuit 204 which generates a reference voltage for generating the drive voltage waveform, a waveform data storage section 206 which stores drive voltage waveform data for generating the drive voltage waveform, and the like. On the printer control circuit 50 instructing the ejection nozzle drive circuit 200 to output a drive voltage waveform, an appropriate drive voltage waveform is output from the drive voltage waveform application section 202 in response to this instruction.

The piezoelectric element is an electrical load (a capacitive load) having a so-called capacitance component, and when a voltage is applied, an electric charge in accordance with the voltage applied is accumulated inside the piezoelectric element. The higher the voltage applied, the more the quantity of electric charge accumulated increases. Conversely, when the voltage applied decreases, the quantity of electric charge accumulated decreases, and the electric charge is emitted. In the embodiment, the ejection nozzle drive circuit 200 of a configuration to be described hereafter is employed in order to efficiently drive the piezoelectric element 104 which drives the ejection nozzle 100.

B-1. Configuration of Ejection Nozzle Drive Circuit

Figure 3:
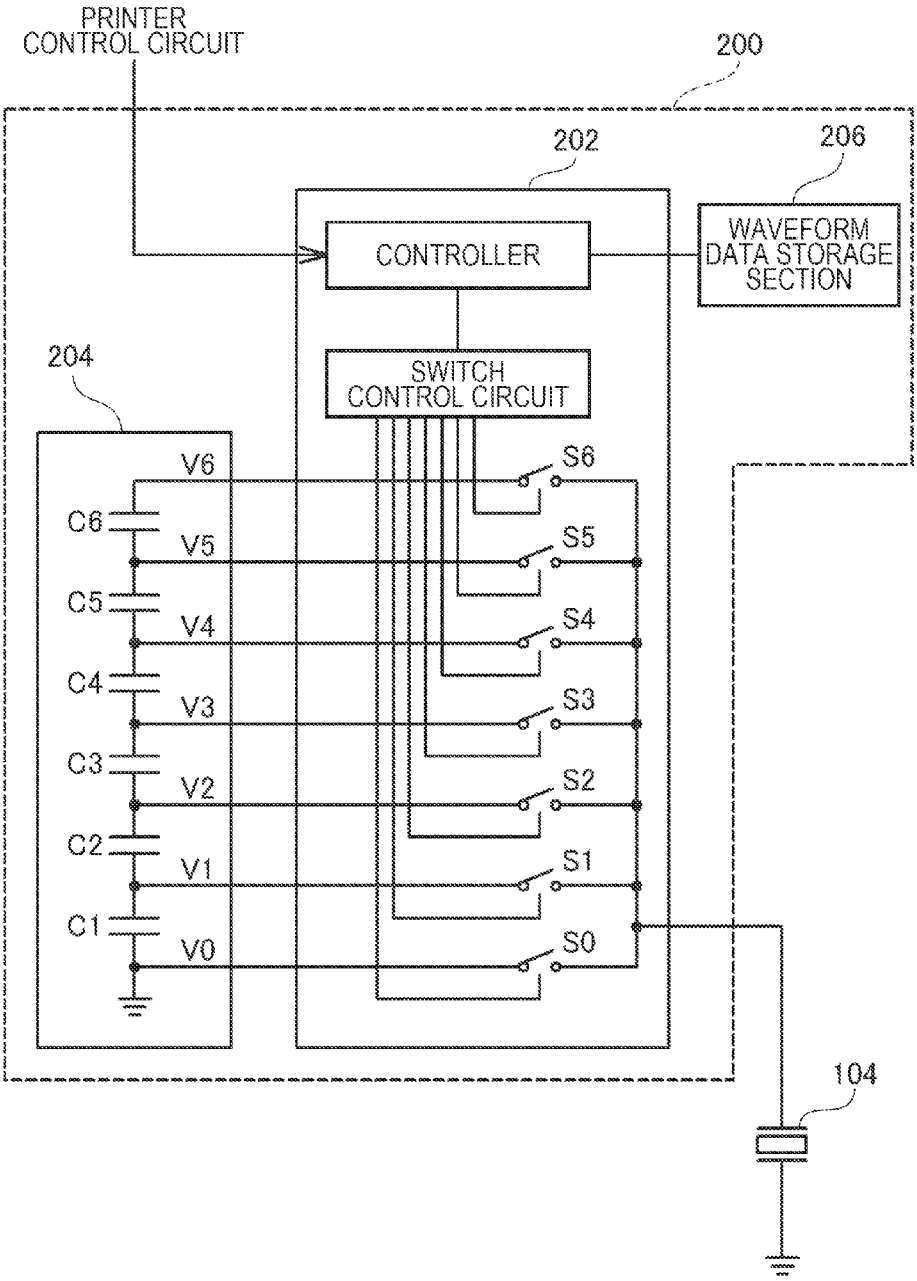
FIG. 3 is an illustration showing a detailed configuration of an ejection nozzle drive circuit of the first embodiment.

FIG. 3 is an illustration showing a detailed configuration of the ejection nozzle drive circuit 200 of the embodiment. As heretofore described, the ejection nozzle drive circuit 200 is configured of the drive voltage waveform application section 202, reference voltage generating circuit 204, waveform data storage section 206, and the like. The drive voltage waveform application section 202 is configured of a plurality of switches S0 to S6, a switch control circuit which controls the switches S0 to S6, a controller which controls the overall operation of the drive voltage waveform application section 202, including the switch control circuit, and the like. A plurality of capacitors C1 to C6 are mounted on the reference voltage generating circuit 204. The capacitors C1 to C6, as well as being charged by the same voltage (Ve), are mutually connected in series. For this reason, it is possible to extract a one capacitor's worth of voltage V1 (=Ve), a voltage V2 (=2Ve) from two capacitors connected in series, a voltage V3 (=3Ve) from three capacitors connected in series, a voltage V4 (=4Ve) from four capacitors connected in series, a voltage V5 (=5Ve) from five capacitors connected in series, a voltage V6 (=6Ve) from six capacitors connected in series, and the like. In the event that a voltage V0 of the ground is added to the six voltages V1 to V6, it means that a total of seven stages of voltage V0 to V6 are generated as reference voltages.

Of the seven stages of voltage V0 to V6 (reference voltages) generated in the reference voltage generating circuit 204, the voltage V0 is connected to the switch S0 of the drive voltage waveform application section 202. In the same way, the voltage V1 generated in the reference voltage generating circuit 204 is connected to the switch S1 of the drive voltage waveform application section 202, the voltage V2 is connected to the switch S2, the voltage V3 to the switch S3, the voltage V4 to the switch S4, the voltage V5 to the switch S5, and the voltage V6 to switch S6. Consequently, it is possible to switch the voltages to be applied to the piezoelectric element 104 depending on which one of the switches S0 to S6 is to be connected. For example, it is possible to apply the voltage V0 to the piezoelectric element 104 by connecting the switch S0, and it is possible to apply the voltage V1 to the piezoelectric element 104 by connecting the switch S1.

The waveform data storage section 206 is configured of a memory, and data relating to a sequence in which the switches S0 to S6 are connected, and to connection times, are stored therein as the drive voltage waveform data. The controller of the drive voltage waveform application section 202, by controlling the operation of the switch control circuit in accordance with the drive voltage waveform data stored in the waveform data storage section 206, switches the connection condition of the switches S0 to S6. By so doing, it is possible to apply a drive voltage waveform in accordance with the drive voltage waveform data to the piezoelectric element 104, as will be described more fully below.

B-2. Drive Voltage Waveform Generating Method

Figure 4A:
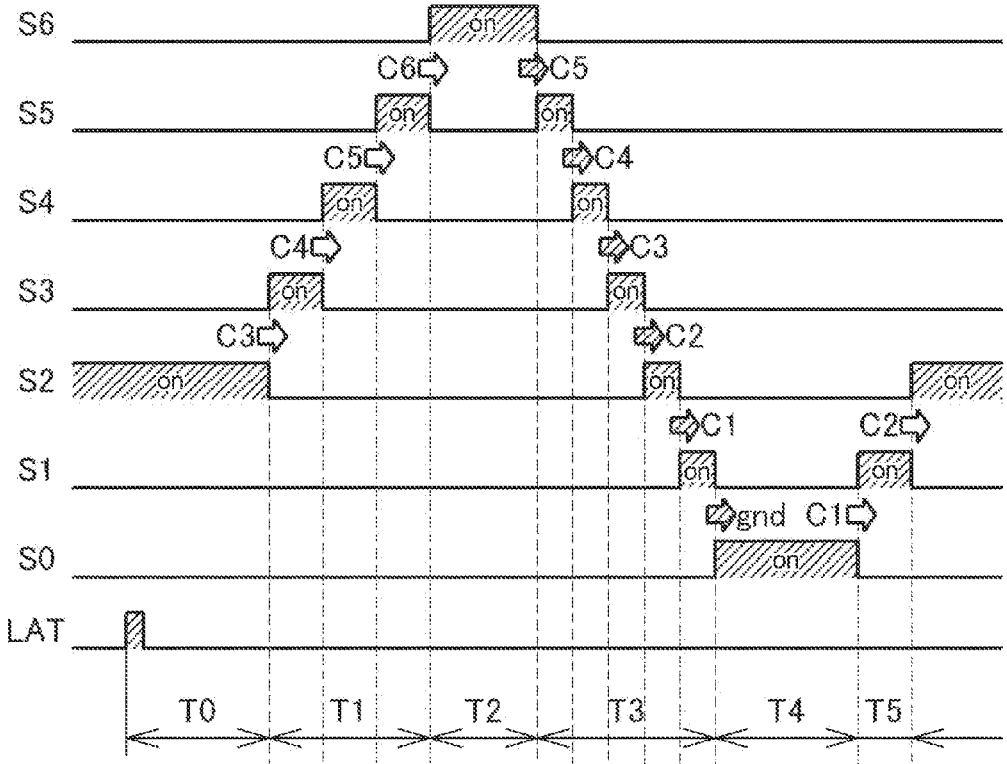
FIGS. 4A to 4C are illustrations showing how a drive voltage waveform application section applies a drive voltage waveform to a piezoelectric element.
Figure 4B:
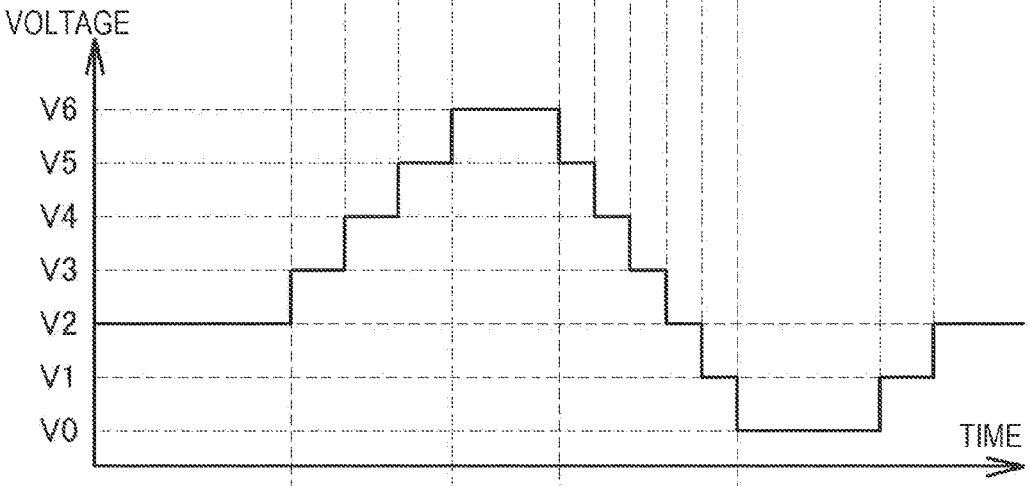
Figure 4C:
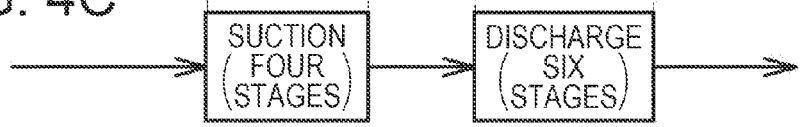

FIGS. 4A to 4C are illustrations showing how the drive voltage waveform application section 202 applies a drive voltage waveform to the piezoelectric element 104. FIG. 4A shows how the connection condition of the switches S0 to S6 is switched, and FIG. 4B shows a drive voltage waveform applied to the piezoelectric element 104. FIG. 4C shows an operation of the piezoelectric element 104 accompanying the drive voltage waveform being applied thereto. As shown in FIG. 4A, at first, the switch S2 is set to on (the connection condition), and the other switches are set to off (the cut-off condition). As is obvious from the configuration of the drive voltage waveform application section 202 shown in FIG. 3, in the condition in which the switch S2 is set to on, the capacitor C2 which generates the voltage V2 (to be exact, the capacitor C1 and capacitor C2) is connected to the piezoelectric element 104, and the voltage V2 is applied to the piezoelectric element 104 (refer to FIG. 4B).

Continuing, as shown in FIG. 4A, as well as the switch S2 being turned off, the switch S3 is turned on. By so doing, the capacitor connected to the piezoelectric element 104 switches from the capacitor C2 which generates the voltage V2 (to be exact, the capacitor C1 and capacitor C2) to the capacitor C3 which generates the voltage V3 (to be exact, the capacitors C1 to C3), so the applied voltage of the piezoelectric element 104 increases from the voltage V2 to the voltage V3 (refer to FIG. 4B). As the piezoelectric element 104 is a capacitive load, as heretofore described, in order to increase the applied voltage from the voltage V2 to the voltage V3, it is necessary to supply an electric charge to the piezoelectric element 104, and the electric charge is supplied from the capacitor C3 newly switched (to be exact, the capacitors C1 to C3). In FIG. 4A, the display "C3" and the blanked arrow are shown in the portion in which the connection condition switches from the condition in which the switch S2 is on to the condition in which the switch S3 is on, which represents that the electric charge is supplied from the capacitor C3 (to be exact, the capacitors C1 to C3) toward the piezoelectric element 104 at this timing.

Next, as well as the switch S3 being turned off, the switch S4 is turned on. By so doing, the capacitor connected to the piezoelectric element 104 switches from the capacitor C3 which generates the voltage V3 (to be exact, the capacitors C1 to C3) to the capacitor C4 which generates the voltage V4 (to be exact, the capacitors C1 to C4). As a result of this, an electric charge is supplied to the piezoelectric element 104 from the capacitor C4 newly switched, and the applied voltage of the piezoelectric element 104 increases from the voltage V3 to the voltage V4 (refer to FIG. 4B). In FIG. 4A, the display "C4" and the blanked arrow are displayed in the position in which the switch S3 switches to off, and the switch S4 switches to on, which represents that the electric charge is supplied from the capacitor C4 (to be exact, the capacitors C1 to C4) toward the piezoelectric element 104.

Similarly, by turning off the switch S4, and turning on the switch S5, an electric charge is supplied to the piezoelectric element 104 from the capacitor C5 (to be exact, the capacitors C1 to C5) to increase the applied voltage from the voltage V4 to the voltage V5, and furthermore, by turning off the switch S5, and turning on the switch S6, the applied voltage of the piezoelectric element 104 is increased from the voltage V5 to the voltage V6. An electric charge necessary when increasing the applied voltage from the voltage V4 to the voltage V5 is supplied from the capacitor C5 (to be exact, the capacitors C1 to C5), and an electric charge necessary when increasing the applied voltage from the voltage V5 to the voltage V6 is supplied from the capacitor C6 (to be exact, the capacitors C1 to C6).

After the switches to be tuned on have been switched in order from the switch S2 to the switch S6, as previously described, to increase the applied voltage of the piezoelectric element 104 from the voltage V2 to the voltage V6, this time, by switching the switches to be turned on in a reverse direction, the applied voltages of the piezoelectric element 104 is decreased. That is, from the condition in which the switch S6 is on, the switch S6 is turned off, and the switch S5 is turned on. By so doing, the capacitor connected to the piezoelectric element 104 switches from the capacitor C6 which generates the voltage V6 (to be exact, the capacitors C1 to C6) to the capacitor C5 which generates the voltage V5 (to be exact, the capacitors C1 to C5), as a result of which the electric charge accumulated in the piezoelectric element 104 is supplied to the capacitor C5 (to be exact, the capacitors C1 to C5), and the applied voltage of the piezoelectric element 104 decreases from the voltage V6 to the voltage V5. In FIG. 4A, the shaded arrow and the display "C5" are displayed in the portion in which the connection condition switches from the condition in which the switch S6 is on to the condition in which the switch S5 is on, which represents that the electric charge emitted from the piezoelectric element 104 is recovered by the capacitor C5 (to be exact, the capacitors C1 to C5).

Similarly, by turning off the switch S5, and turning on the switch S4, the electric charge of the piezoelectric element 104 is recovered by the capacitor C4 (to be exact, the capacitors C1 to C4) to decrease the applied voltage from the voltage V5 to the voltage V4. Furthermore, by turning off the switch S4, and turning on the switch S3, the applied voltage of the piezoelectric element 104 is decreased from the voltage V4 to the voltage V3, and by turning off the switch S3, and turning on the switch S2, the applied voltage of the piezoelectric element 104 is decreased from the voltage V3 to the voltage V2. When the applied voltage decreases from the voltage V4 to the voltage V3, the electric charge of the piezoelectric element 104 is recovered by the capacitor C3 (to be exact, the capacitors C1 to C3), and when the applied voltage decreases from the voltage V3 to the voltage V2, the electric charge of the piezoelectric element 104 is recovered by the capacitor C2 (to be exact, the capacitors C1 and C2). By switching the switches to be turned on in order in this way, thus eventually turning off the switch S1 and turning on the switch S0, it is possible to decrease the applied voltage of the piezoelectric element 104 to the voltage V0.

As illustrated in the configuration of the drive voltage waveform application section 202 shown in FIG. 3, on turning on the switch S0, the ground is connected to the piezoelectric element 104, meaning that, when the applied voltage decreases from the voltage V1 to the voltage V0, the electric charge of the piezoelectric element 104 is discharged into the ground. In FIG. 4A, the shaded arrow and the display "gnd" are displayed at a timing at which the connection condition switches from the condition in which the switch S1 is on to the condition in which the switch S0 is on, which represents that the electric charge from the piezoelectric element 104 is discharged into the ground.

After the applied voltage of the piezoelectric element 104 has been decreased to the voltage V0 by switching the switches to be turned on in order from the switch S6 to the switch S5, from the switch S5 to the switch S4, from the switch S4 to the switch S3, from the switch S3 to the switch S2, from the switch S2 to the switch S1, and from the switch S1 to the switch S0 in the way heretofore described, this time, the switches to be turned on are switched from the switch S0 to the switch S1, and from the switch S1 to the switch S2. By so doing, it is possible to increase the applied voltage of the piezoelectric element 104 from the voltage V0 to the voltage V2.

As shown in FIG. 4A, using a latch signal LAT as a reference, a timing to start increasing the voltage is determined to be after the elapse of a time T0 from the latch signal LAT, and a time for which the voltage is increased, a time for which the increased voltage is held, a time for which the voltage is decreased, a time for which the decreased voltage is held, and a time for which the voltage is increased to the initial voltage are determined as a time T1, a time T2, a time T3, a time T4, and a time T5 respectively. By so doing, it is possible to apply the kind of step-like voltage waveform shown in FIG. 4B to the piezoelectric element 104.

When increasing the applied voltage of the piezoelectric element 104 from the voltage V2 to the voltage V3, as an electric charge is supplied to the piezoelectric element 104 from the capacitor C3 (to be exact, the capacitors C1 to C3) which generates the voltage V3, the electric charge of the capacitor C3 (to be exact, the capacitors C1 to C3) decreases. However, when the applied voltage of the piezoelectric element 104 decreases from the voltage V4 to the voltage V3, the capacitor C3 (to be exact, the capacitors C1 to C3) can recover an electric charge from the piezoelectric element 104 (refer to FIG. 4A). Consequently, when comparing the electric charge accumulated in the capacitor C3 before and after outputting the kind of voltage waveform in FIG. 4B, little change can be seen. The same applies to the other capacitors too. For example, with regard to the capacitor C4 which generates the voltage V4, it emits an electric charge when increasing the applied voltage of the piezoelectric element 104 from the voltage V3 to the voltage V4, but can recover an electric charge when the applied voltage decreases from the voltage V5 to the voltage V4. With regard to the capacitor C2 which generates the voltage V2, it accumulates the electric charge emitted from the piezoelectric element 104 when the applied voltage decreases from the voltage V3 to the voltage V2, but an electric charge is supplied to the piezoelectric element 104 when increasing the applied voltage from the voltage V1 to the voltage V2. Consequently, the quantity of electric charge accumulated in the capacitor C2 does not change significantly before and after outputting a voltage waveform.

By way of comparison, the capacitor C6 which generates the voltage V6 is slightly different from the other capacitors C1 to C5. That is, the capacitor C6 supplies an electric charge to the piezoelectric element 104 when increasing the applied voltage of the piezoelectric element 104 from the voltage V5 to the voltage V6, but the electric charge is recovered by the capacitor C5 (to be exact, the capacitors C1 to C5) when the applied voltage of the piezoelectric element 104 decreases from the voltage V6 to the voltage V5. In this way, with regard to the capacitor C6 which generates the voltage V6 which is the highest voltage, as it cannot recover an electric charge from the piezoelectric element 104, the electric charge accumulated therein decreases while the voltage waveform is being output. Consequently, there occurs a need to gradually replenish the capacitor C6 with an electric charge from an external power supply. However, there is little need to replenish the other capacitors C1 to C5 with an electric charge. Moreover, as it is sufficient to supply the capacitor C6 with only an electric charge for increasing the applied voltage from the voltage V5 to the voltage V6 despite the applied voltage being changed within a range of the voltage V0 to the voltage V6, it is possible to drive the piezoelectric element 104 very efficiently.

On the voltage waveform generated in the way heretofore described being applied, the piezoelectric element 104 of the ejection nozzle 100 carries out the following kind of operation. FIG. 4C shows a general operation of the piezoelectric element 104 when the drive voltage waveform of FIG. 4B is applied thereto. As shown in FIG. 4B, as the applied voltage is maintained at the initial voltage V2 during the initial time T0, the piezoelectric element 104 also maintains its initial condition. However, when the initial time T0 elapses, the applied voltage increases, and the piezoelectric element 104 deforms in a direction in which it increases the volume of the ink chamber 102. As a result of this, ink is suctioned into the ink chamber 102 from the ink cartridge 26. This ink suction operation is carried out by taking the time T1 to increase the applied voltage in four stages, from the voltage V2 to the voltage V3, from the voltage V3 to the voltage V4, from the voltage V4 to the voltage V5, and from the voltage V5 to the voltage V6. As a result of this, the piezoelectric element 104 deforms by an amount equivalent to four stages' worth of voltage difference (the voltage V6−the voltage V2), meaning that ink of a volume approximately equal to this deformation amount is supplied to the ink chamber 102.

After the condition in which the ink is suctioned in this way has been held during the time T2, this time, the applied voltage decreases, and the piezoelectric element 104 deforms in a direction in which it reduces the volume of the ink chamber 102. As a result of this, the ink suctioned into the ink chamber 102 is discharged in a droplet form from the ejection nozzle 100 in such a way as to be pushed out. This discharge operation is carried out by taking the time T3 to decrease the applied voltage in six stages, from the voltage V6 to the voltage V5, from the voltage V5 to the voltage V4, from the voltage V4 to the voltage V3, from the voltage V3 to the voltage V2, from the voltage V2 to the voltage V1, and from the voltage V1 to the voltage V0. As a result of this, the piezoelectric element 104 deforms by an amount equivalent to six stages' worth of voltage difference (the voltage V6−the voltage V0), and ink of a volume in accordance with this deformation amount is discharged from the ejection nozzle 100.

As described above, the ejection amount of a liquid ejected from the ejection nozzle 100 (herein, the size of an ink droplet discharged, or a discharge weight) depends upon the quantity of stages in which the applied voltage is changed in the discharge operation (a discharge stage quantity). Consequently, in order to increase the liquid ejection amount (ink discharge weight), it is sufficient to increase the discharge stage quantity, and conversely, in order to reduce the ejection amount (discharge weight), it is sufficient to reduce the discharge stage quantity. In order to increase the discharge stage quantity, there occurs a need to change the applied voltage by a certain stage quantity of the suction operation too which is carried out prior to the discharge operation. Similar to the quantity of stages in which the applied voltage is changed in the discharge operation being called the discharge stage quantity, the quantity of stages in which the applied voltage is changed in the suction operation may hereafter be called a suction stage quantity.

Figure 5A:
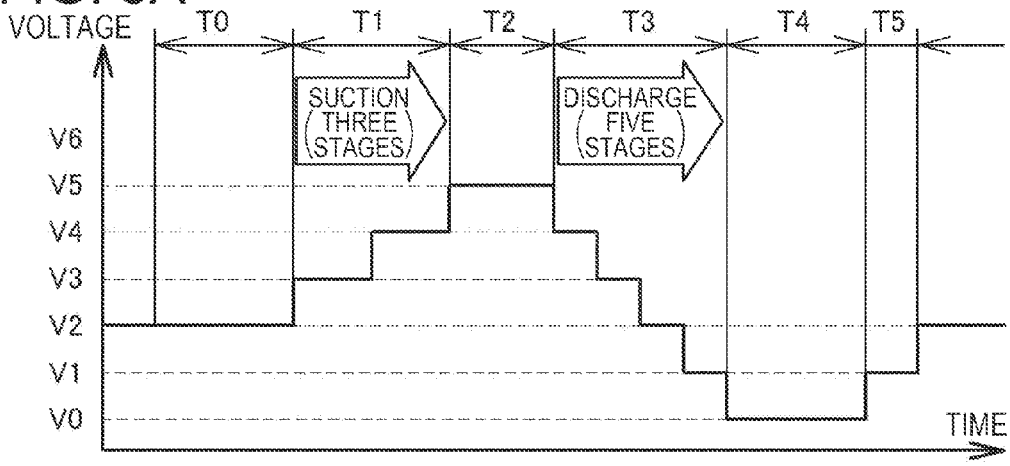
FIGS. 5A to 5C are illustrations showing how the discharge stage quantity of the drive voltage waveform is changed and the ejection amount of ink is changed.
Figure 5B:
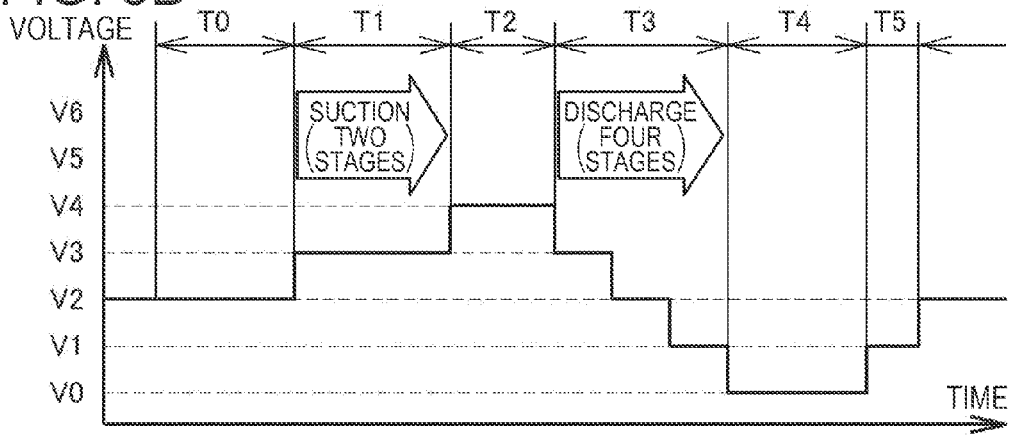
Figure 5C:
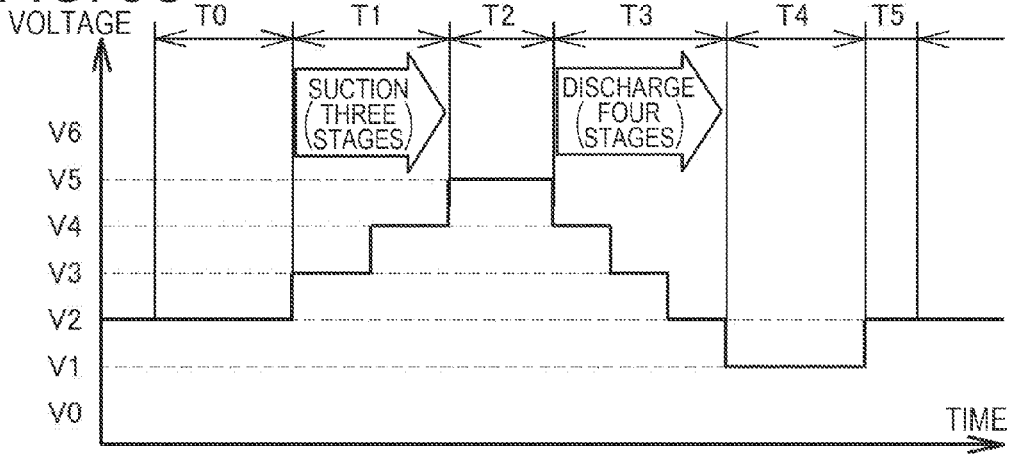

FIGS. 5A to 5C are illustrations illustrating how the discharge stage quantity of the drive voltage waveform is changed, thereby changing the ink ejection amount (discharge weight). In FIG. 5A, the suction operation is carried out by increasing the applied voltage by three stages from the voltage V2 to the voltage V5, and in the discharge operation, the applied voltage is decreased by five stages from the voltage V5 to the voltage V0. Consequently, compared to the drive voltage waveform shown in FIG. 4B, the discharge stage quantity is reduced from six to five, by which amount the ejection amount (discharge weight) of ink ejected from the ejection nozzle 100 decreases.

In the example shown in FIG. 5B, a suction operation whose suction stage quantity is two is carried out by increasing the applied voltage from the voltage V2 to the voltage V4, and in a discharge operation to follow, a discharge operation whose discharge stage quantity is four is carried out by decreasing the applied voltage from the voltage V4 to the voltage V0. Consequently, in the drive voltage waveform shown in FIG. 5B, the ejection amount (discharge weight) of ink ejected from the ejection nozzle 100 becomes still smaller than in the drive voltage waveform shown in FIG. 5A.

Heretofore, an example has been described as one in which the stage quantity of the suction operation (the suction stage quantity) is performed before the discharge operation is changed, by which amount the stage quantity of the discharge operation (the discharge stage quantity) is changed. For example, in the example shown in FIG. 5A, by reducing the suction stage quantity to three, although the four-stage suction operation is carried out in the drive voltage waveform of FIG. 4B, the discharge stage quantity is reduced from six to five. In the example shown in FIG. 5B, by reducing the suction stage quantity to two, although the three-stage suction operation is carried out in the drive voltage waveform of FIG.

5A, the discharge stage quantity is reduced from five to four. As opposed to this, it is also possible to change only the discharge stage quantity while maintaining the suction stage quantity. For example, in the example shown in FIG. 5C, the discharge stage quantity is reduced from five to four with the suction stage quantity maintained at three. By changing the discharge stage quantity in this way too, it is possible to change the ejection amount (discharge weight) of ink discharged from the ejection nozzle 100.

Typically, when the discharge stage quantity is changed, the ink ejection amount (discharge weight) undergoes a large change. Consequently, while it is possible to change the ejection amount (discharge weight) roughly, it is not possible to adjust it finely. Therein, with the inkjet printer 10 of the embodiment, by using the following kind of method, it is possible to adjust the ink ejection amount (discharge weight) finely.

C. Ejection Amount (Discharge Weight) Adjusting Method

Figure 6A:
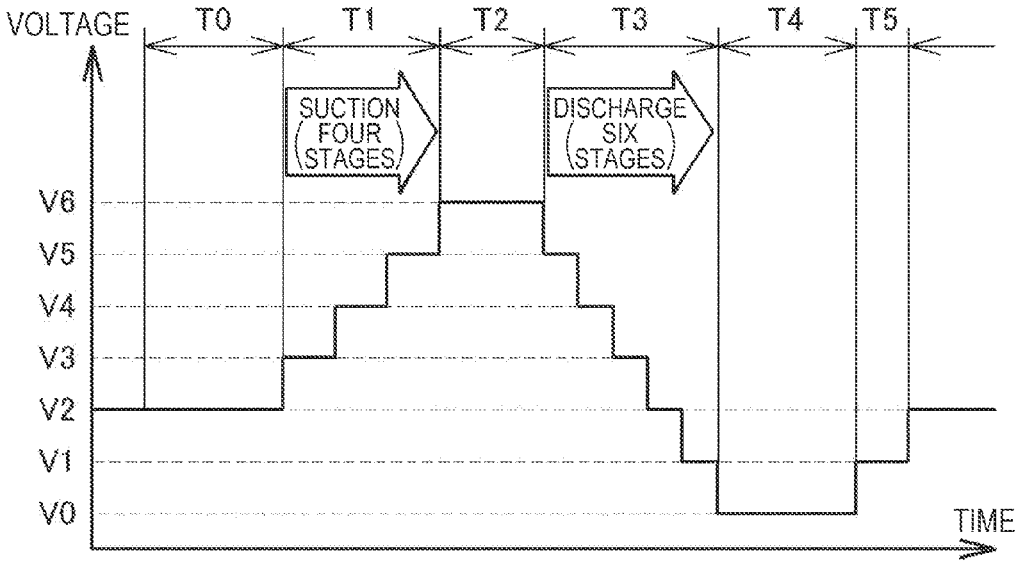
FIGS. 6A and 6B are illustrations illustrating a basic method when the inkjet printer of the embodiment adjusts the ink ejection amount.
Figure 6B:
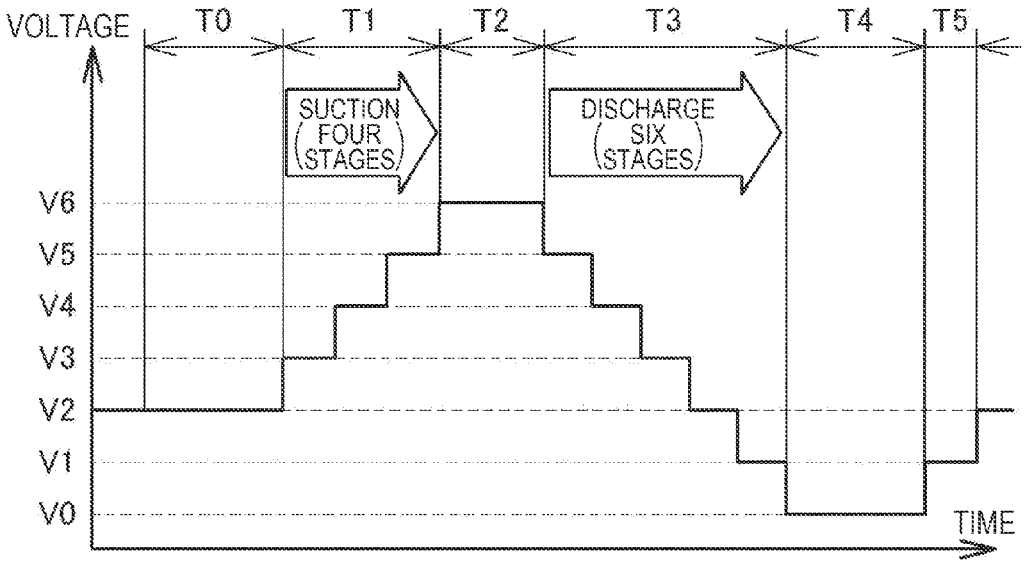

FIGS. 6A and 6B are illustrations illustrating a basic method wherein the inkjet printer 10 of the embodiment makes a fine adjustment of the ink ejection amount (discharge weight). In both the drive voltage waveform illustrated in FIG. 6A and the drive voltage waveform illustrated in FIG. 6B, the suction stage quantity is set to four, and the discharge stage quantity is set to six, but the length of a time for which a discharge operation is carried out (a discharge time; herein, the time T3) is longer in the drive voltage waveform of FIG. 6B than in the drive voltage waveform of FIG. 6A. Consequently, no matter which drive voltage waveform is applied, the deformation amount of the piezoelectric element 104 (the amount of reduction in the volume of the ink chamber 102) is the same, but when the drive voltage waveform of FIG. 6A is applied, the piezoelectric element 104 quickly deforms and pushes out the ink in the ink chamber 102, while when the drive voltage waveform of FIG. 6B is applied, the piezoelectric element 104 deforms slowly, and pushes out the ink in the ink chamber 102 slowly. As a result of this, a slight difference occurs in the ejection amount (discharge weight) of ink ejected from the ejection nozzle 100.

Figure 7:
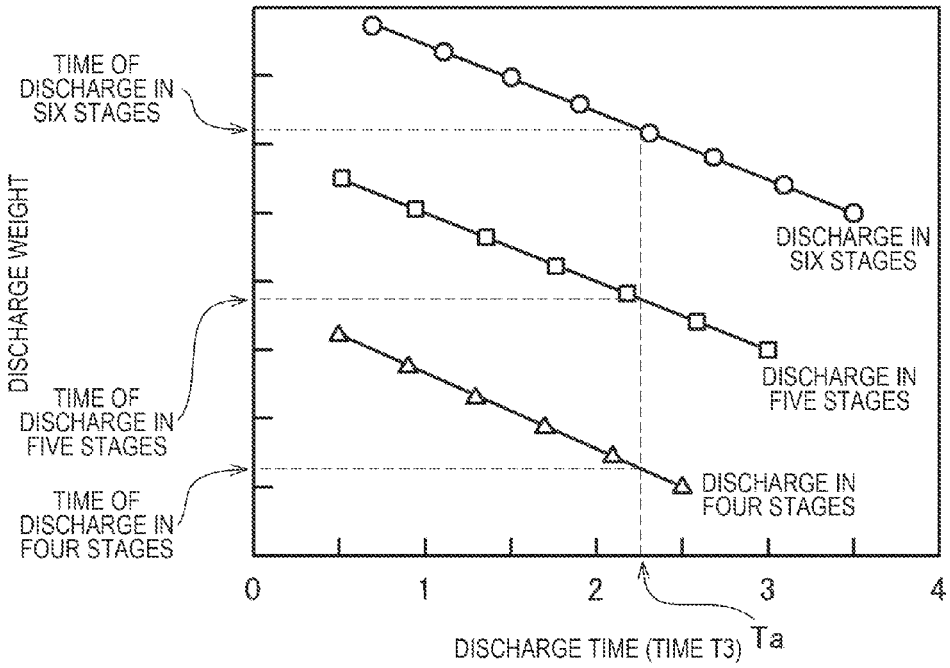
FIG. 7 is an illustration conceptually showing a result obtained by changing the length of the discharge time of the drive voltage waveform and measuring the ink ejection amount.

FIG. 7 is an illustration conceptually showing results obtained by measuring the ejection amounts (discharge weights) of ink ejected from the ejection nozzle 100 by changing the length of the discharge time (time T3) in the drive voltage waveform. With regard to the discharge stage quantity in the drive voltage waveform, a measurement is made in each of the cases of six stages, five stages, and four stages. The data shown by the blank circle in the diagram represents a measurement result obtained when the discharge stage quantity is six, and the data shown by the blanked square represent a measurement result when the discharge stage quantity is four. The data shown by the blank triangle represent a measurement result when the discharge stage quantity is three.

As shown in FIG. 7, the longer the discharge time (time T3), the more the ink ejection amount (discharge weight) decreases. This is considered to be because the longer the discharge time (time T3), the more slowly the ink in the ink chamber 102 is pushed out, and becomes more difficult to discharge, thus reducing the discharge weight. In when the speed of pushing out the ink in the ink chamber 102 becomes too slow, it becomes impossible to discharge the ink, or it becomes impossible to discharge ink droplets of a stable weight even though it is possible to discharge the ink. Consequently, in order to discharge the ink stably, the discharge time (time T3) is limited to a certain length. In a case in which the same length of the discharge time (time T3) is set, the larger the discharge stage quantity, the ink discharge weight also becomes larger. This is because, since the volume of the ink chamber 102 decreases drastically as the discharge stage quantity becomes larger, as heretofore described, the amount of ink pushed out increases.

As is obvious from the measurement results shown in FIG. 7, by changing the discharge stage quantity, it is possible to change the discharge weight significantly, and by changing the discharge time (time T3), it is possible to adjust the discharge weight finely. Therein, with one discharge stage quantity, the discharge time (time T3) is changed within a range in which ink can be stably discharged, and the ejection amount (discharge weight) of the ink is measured. Continuing, after the one discharge stage quantity has been changed by one, the discharge time (time T3) is changed within a range in which ink can be stably discharged, and the ejection amount (discharge weight) of the ink is measured. At this time, the discharge weight obtained with the former discharge stage quantity, and the discharge weight obtained with the latter discharge stage quantity, are adjusted in such a way that their measurement ranges almost exactly coincide with each other. For example, in the event that the discharge time (time T3) has room within the range in which the ink can be stably discharged, the measurement range of the discharge time (time T3) is extended. When the discharge weight measurement ranges do not coincide with each other simply by extending the measurement range of the discharge time (time T3), as a voltage change per stage has to be made small, there occurs a need to increase the number of capacitors in the reference voltage generating circuit 204 and the number of switches in the drive voltage waveform application section 202. FIG. 7 shows the measured values of discharge weights obtained in this way. Based on these kinds of measured value, a drive voltage waveform is determined for each ink discharge weight.

Figure 8:
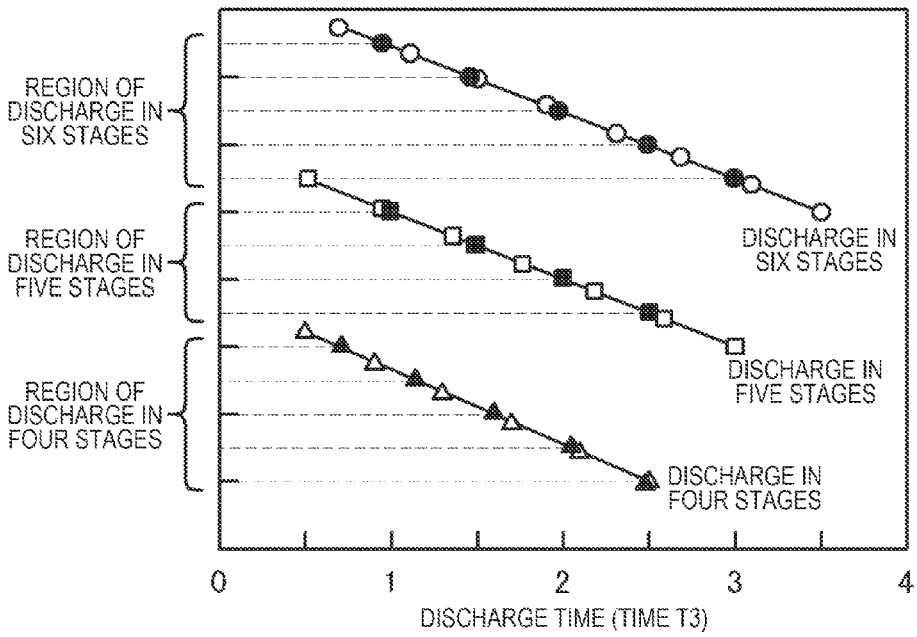
FIG. 8 is an illustration showing how the drive voltage waveform is determined for each discharge weight of ink.

FIG. 8 is an illustration showing how a drive voltage waveform to be applied to the piezoelectric element 104 is determined for each ink discharge weight. In the example shown in the diagram, a plurality of discharge weights are set at constant intervals, and the discharge stage quantity and discharge time (time T3) of the drive voltage waveform determined for each discharge weight are shown by a black circle, a black square, or a black triangle. Consequently, when attempting to obtain a discharge stage quantity and discharge time (the time T3) for one discharge weight, first of all, the discharge stage quantity is determined based on the discharge weight, and then, from the relationship between the discharge time (time T3) measured with the discharge stage quantity and the discharge weight, the discharge time (time T3) for the discharge weight to be obtained can be calculated by an interpolation operation. As a discharge weight measured with one discharge stage quantity almost exactly coincides with a discharge weight measured with the neighboring discharge stage quantity, as previously described, it is possible to determine discharge stage quantities and discharge times (times T3) corresponding to all the discharge weights set at constant intervals.

By predetermining and storing the discharge stage quantity and discharge time (time T3) for each discharge weight in this way, it is possible to easily carry out a fine adjustment of the ink ejection amount (discharge weight). For example, it is taken that there occurs a need to slightly increase the ejection amount (discharge weight) when the piezoelectric element 104 is being driven with one drive voltage waveform. In this case, it is sufficient to check the discharge stage quantity and discharge time (time T3) of the drive voltage waveform, obtain a combination of discharge stage quantity and discharge time (time T3) wherein the discharge weight is slightly greater than that in the combination of discharge stage quantity and discharge time (time T3) obtained, and change the drive voltage waveform. As heretofore described using FIGS. 4A to 4C, with the ejection nozzle drive circuit 200 of the embodiment, by changing the switch switching operation in the drive voltage waveform application section 202, it is possible to easily change the discharge stage quantity and discharge time (time T3) of the drive voltage waveform.

Data including the discharge stage quantity and discharge time (time T3) determined for each ink discharge weight in this way are stored in advance, as the drive voltage waveform data, in the waveform data storage section 206 of the ejection nozzle drive circuit 200. The drive voltage waveform application section 202 of the ejection nozzle drive circuit 200, by controlling the switch switching operation based on the drive voltage waveform data retrieved from the waveform data storage section 206, generates a voltage waveform corresponding to the drive voltage waveform data, and applies it to the piezoelectric element 104. Hereafter, a description will be given of a process in which the ejection nozzle drive circuit 200 of the embodiment generates a drive voltage waveform, and applies it to the piezoelectric element 104 of the ejection nozzle 100.

D. Ejection Nozzle Drive Process

Figure 9:
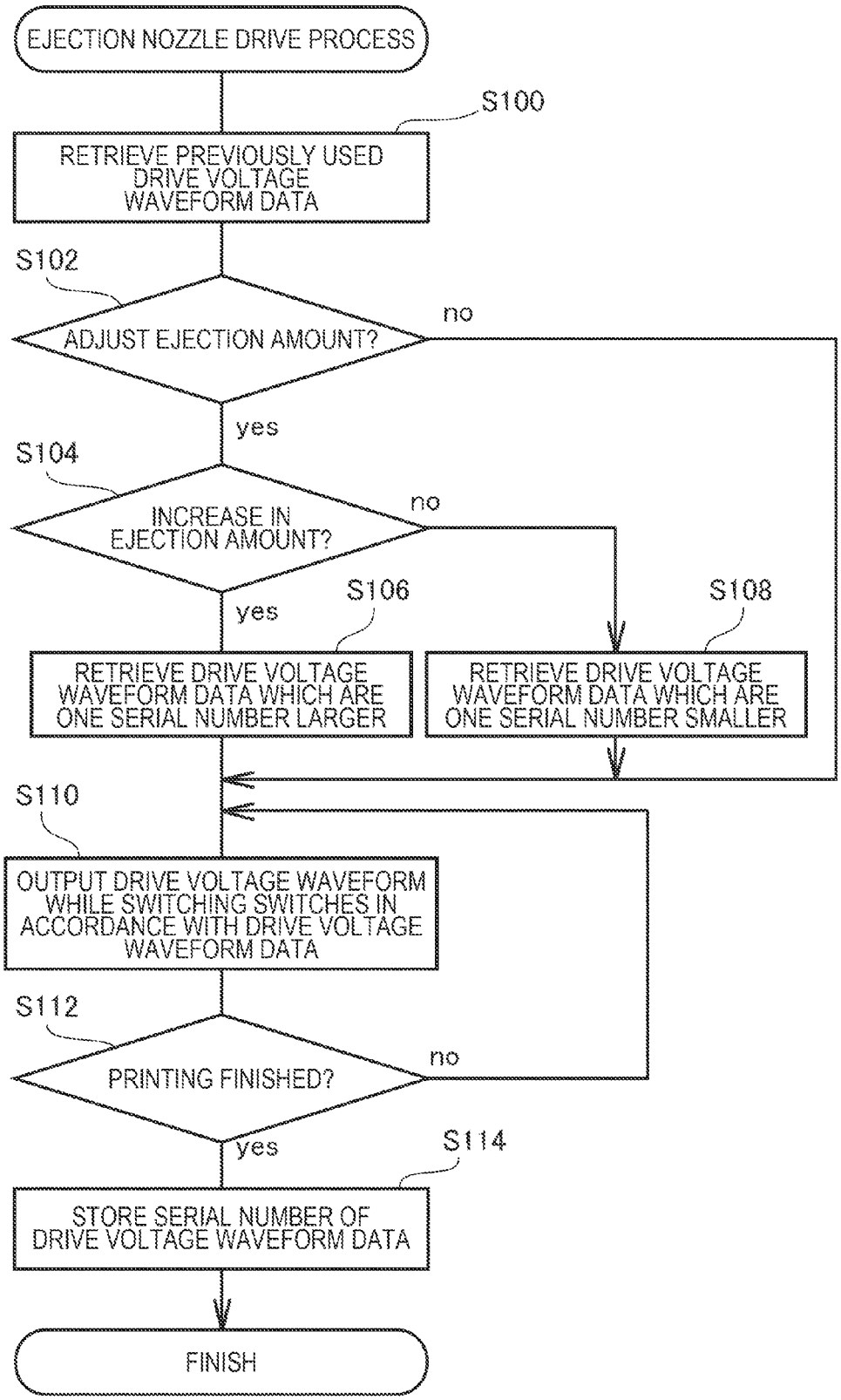
FIG. 9 is a flowchart showing an ejection nozzle drive process in which the ejection nozzle drive circuit of the first embodiment drives the ejection nozzle.

FIG. 9 is a flowchart showing an ejection nozzle drive process in which the ejection nozzle drive circuit 200 of the embodiment, by generating a drive voltage waveform, and applying it to the piezoelectric element 104, drives the ejection nozzle 100. The process is one which, on an instruction to start a printing being received from the printer control circuit 50, is executed by the ejection nozzle drive circuit 200.

As shown in the diagram, once the ejection nozzle drive process starts, first of all, the previously used drive voltage waveform data are retrieved (step S100). Herein, drive voltage waveform data, which is data for generating a drive voltage waveform, is stored in the waveform data storage section 206.

Figures 10A, 10B, 10C:
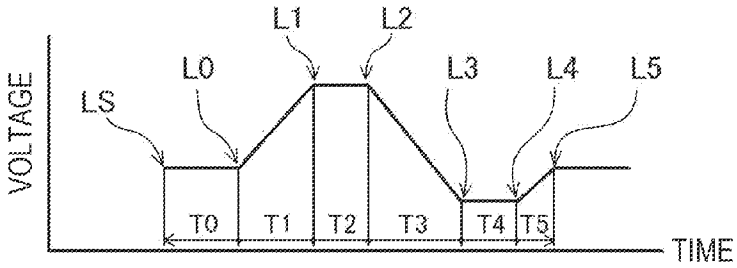
FIGS. 10A to 10C are illustrations showing drive voltage waveform data stored in a waveform data storage section.

FIGS. 10A, 10B, and 10C are illustrations showing the drive voltage waveform data stored in the waveform data storage section 206. For ease of understanding, what the drive voltage waveform data mean is shown in FIG. 10B, and a computation expression for calculating a switch switching timing based on the drive voltage waveform data is shown in FIG. 10C.

As heretofore described using FIG. 8, the drive voltage waveform data are set one item for each ink discharge weight. In response to this, in the example shown in FIG. 10A, the drive voltage waveform data are set one item for each of the plurality of discharge weights set at 0.2 ng intervals within a discharge weight range of 8.0 to 11.0 ng. Information, such as which reference voltage should be first connected to the piezoelectric element 104, which reference voltage should that reference voltage be switched to, and how long each stage should take, is described in the drive voltage waveform data. As only a preset plurality of voltages (herein, the voltage V0 to the voltage V6) can be taken as the reference voltages, not the value itself of a reference voltage, but a value (a stage quantity) indicating what number from the bottom the reference voltage is among the preset plurality of reference voltages, is set in the drive voltage waveform data. Furthermore, the individual items of drive voltage waveform data are numbered serially.

A detailed description will be given, while referring to FIG. 10B, of what the drive voltage waveform data mean. In FIG. 10B, a drive voltage waveform is displayed simplified in a polygonal line waveform. That is, as heretofore described using FIGS. 4A to 4C, the drive voltage waveform is configured roughly by a section in which the voltage is held (a holding section), a section in which the voltage increases (an increasing section), and a section in which the voltage decreases (a decreasing section) being repeated in a predetermined order. Consequently, by each section (waveform section) being approximated by a straight line, the drive voltage waveform can be simplified and displayed in an approximately polygonal line waveform.

When the drive voltage waveform is simplified into a polygonal line form in this way, a total of six inflection points appear in positions indicated as "L0", "L1", "L2", "L3", "L4", and "L5" in FIG. 10B. In the drive voltage waveform data, the shape of the drive voltage waveform is described using voltages in seven positions, wherein the leading position (displayed as "LS" in FIG. 10B) of the drive voltage waveform is added to the six inflection points, and a time until a voltage at one inflection point switches to a voltage at the next inflection point. That is, after the leading voltage (a voltage at LS) of the drive voltage waveform has been specified, a voltage at the next inflection point (a voltage at L0) and, a time (the time T0) until the leading voltage switches to the voltage at L0, are specified. At this time, in the event that the leading voltage (voltage at LS) and the voltage at the next inflection point (voltage at L0) are the same voltage, the voltage is maintained in a waveform section (the waveform section of the time T0). In the event that the voltage at the inflection point L0 is higher than the voltage at the starting point LS, the voltage takes the time T0 to increase the waveform section, and conversely, in the event that the voltage at the inflection point L0 is lower than the voltage at the starting point LS, the voltage takes the time T0 to decrease.

Following this kind of specification of the voltage at the inflection point L0 and the time T0 until the leading voltage switches to the voltage at L0, furthermore, a voltage at the next inflection point L1 and a time (the time T1) until the voltage at the inflection point L0 switches to the voltage at L1 are specified. In the event that the voltage at the inflection point L0 and the voltage at the inflection point L1 are the same, the voltage is maintained in the waveform section (the waveform section of the time T1) while, in the event that the voltage at the inflection point L1 is higher than the voltage at the inflection point L0, the voltage takes the time T1 to increase in the waveform section, and conversely, in the event that the voltage at L1 is lower than the voltage at L0, the voltage takes the time T1 to decrease. Hereafter, in the same way, by specifying a voltage at an inflection point L2 and the time T2 until the voltage at L1 switches to the voltage at L2, a voltage at an inflection point L3 and the time T3 until the voltage at L2 switches to the voltage at L3, a voltage at an inflection point L4 and the time T4 until the voltage at L3 switches to the voltage at L4, and a voltage at an inflection point L5 and the time T5 until the voltage at L4 switches to the voltage at L5, it is possible to describe the kind of polygonal line shaped drive voltage waveform shown in FIG. 10B.

Herein, as heretofore described, the reference voltages can only take the preset plurality of voltages (herein, the voltage V0 to the voltage V6). Consequently, not the values themselves of the reference voltages, but the stage quantities of the reference voltages are set in the drive voltage waveform data. For example, stage quantities "0" to "6" are set, such as "0" stage in the event of the voltage V0, "1" stage in the event of the voltage V1, and "2" stages in the event of the voltage V2.

When increasing or decreasing the voltage, a timing to switch to a voltage of a partway stage quantity is calculated using the computation equation shown in FIG. 10C. For example, in the event of taking one μ second (μs) to increase the voltage from a first stage voltage to a fifth stage voltage, as one μ second is taken to switch four stages (=five stages−one stage), it is sufficient to switch one stage each time 0.25 (=one μ second/four stages) μ seconds elapses.

As heretofore described, the voltages at the starting point and inflection points when describing a drive voltage waveform using a polygonal line, and the times for switching the voltages, are set in the drive voltage waveform data, and by retrieving the drive voltage waveform data, and applying the computation equation of FIG. 10C, it is possible to determine the order of switching the plurality of reference voltages provided and the switching timings.

As illustrated in FIG. 10A, the drive voltage waveform data are stored, one item for each of the plurality of discharge weights, in the waveform data storage section 206 mounted on the ejection nozzle drive circuit 200 of the embodiment, and the individual items of drive voltage waveform data are numbered serially. In the ejection nozzle drive process shown in FIG. 9, described more fully below, the serial number of an item of drive voltage waveform data is stored when the process is finished, and when the process is started, a process of retrieving the previously used item of drive voltage waveform data is carried out by referring to the drive voltage waveform data of the waveform data storage section 206 using the serial number stored (step S100).

Next, it is determined whether or not to adjust the ejection amount of ink ejected from the ejection nozzle 100 (step S102). In the embodiment, when starting a printing, an operator of the inkjet printer 10, by operating an operating button (not shown) of the inkjet printer 10, or a computer connected to the inkjet printer 10 from the screen (not shown) thereof, can instruct the inkjet printer 10 whether or not to adjust the density when printing, and in the event of adjusting it, whether to darken or lighten it. Then, the printer control circuit 50 of the inkjet printer 10, in response to these instructions, outputs an instruction to the ejection nozzle drive circuit 200. Consequently, the ejection nozzle drive circuit 200, based on the existence or otherwise of an instruction from the printer control circuit 50, can determine whether or not to adjust the ejection amount.

As a result of this, if the ejection nozzle drive circuit 200 determines to adjust the ejection amount (step S102: yes), it determines whether or not the content of the adjustment is an increase in ejection amount (step S104). This determination can also be easily made according to the content of an instruction received from the printer control circuit 50. If the ejection nozzle drive circuit 200 determines that the content is an increase in ejection amount (step S104: yes), it retrieves an item of drive voltage waveform data which is one serial number larger (step S106). As shown in FIGS. 10A to 10C, the drive voltage waveform data are set one item for each of the plurality of ejection amounts (discharge weights), and serial numbers are assigned to the items of drive voltage waveform data, from an item with a small ejection amount (discharge weight) toward an item with a large one. Therein, if the ejection nozzle drive circuit 200 determines that the ejection amount adjustment content is an increase (step S104: yes), it retrieves from the waveform data storage section 206 an item of drive voltage waveform data which is one serial number larger than the current item of drive voltage waveform data. As opposed to this, if the ejection nozzle drive circuit 200 determines that the ejection amount adjustment content is not an increase (step S104: no), it retrieves an item of drive voltage waveform data which is one serial number smaller than the current item of drive voltage waveform data (step S108).

The ejection nozzle drive circuit 200, after retrieving a new item of drive voltage waveform data in this way, by switching the switches S0 to S6 in accordance with the retrieved item of drive voltage waveform data, outputs a drive voltage waveform (step S110).

For example, in the event that the ejection nozzle drive circuit 200 has retrieved the item of drive voltage waveform data of the serial number "1" illustrated in FIG. 10A, firstly, it turns on the switch S2 in order to output the voltage V2, and turns off the other switches. After holding this condition for two μ seconds (the time T0), next, the ejection nozzle drive circuit 200, in order to take 4.5μ seconds (the time T1) to increase the output voltage from the voltage V2 to the voltage V4, switches the switches from a condition in which the switch S2 is on to a condition in which the switch S3 is on, and then to a condition in which the switch S4 is on, each time 2.25μ seconds elapse (refer to the computation equation of FIG. 10C).

After holding the voltage V4 in a condition in which it is being output for 2.5μ seconds (the time T2), the ejection nozzle drive circuit 200, in order to take 2.4μ seconds (the time T3) to decrease the output voltage from the voltage V4 to the voltage V0, switches the switches from the condition in which the switch S4 is on to the condition in which the switch S3 is on, to the condition in which the switch S2 is on to a condition in which the switch S1 is on, and then to a condition in which the switch S0 is on, each switching process taking 0.6μ seconds to elapse. Henceforth too, in the same way, the ejection nozzle drive circuit 200, by switching the connection condition of the switches S0 to S6 in accordance with the drive voltage waveform data, can output a drive voltage waveform corresponding to the drive voltage waveform data.

Meanwhile, if the ejection nozzle drive circuit 200 determines not to adjust the ejection amount (step S102 of FIG. 9: no), by switching the switches S0 to S6 in accordance with the previously retrieved drive voltage waveform data, it outputs a drive voltage waveform (step S110).

The ejection nozzle drive circuit 200, after outputting the drive voltage waveform in the way heretofore described, determines whether or not the printing has finished (step S112). When the printing finishes, as an instruction to that effect is output from the printer control circuit 50, the ejection nozzle drive circuit 200 immediately determines whether or not the printing has finished. If the printing has not finished yet (step S112: no), the ejection nozzle drive circuit 200, by switching the switches S0 to S6 again in accordance with the drive voltage waveform data, outputs a drive voltage waveform toward the piezoelectric element 104 (step S110). The ejection nozzle drive circuit 200 determines whether or not the printing has finished (step S112). The ejection nozzle drive circuit 200 repeats this of process until it receives an instruction to finish the printing from the printer control circuit 50, and if it is determined that the printing has finished (step S112: yes), the ejection nozzle drive circuit 200 stores the serial number of the drive voltage waveform data used in outputting the drive voltage waveform (S114), and finishes the ejection nozzle drive process of FIG. 9. The serial number of the drive voltage waveform data used may also be stored in the waveform data storage section 206. Alternatively, it may also be stored in a memory provided in the controller of the drive voltage waveform application section 202.

Figure 11:
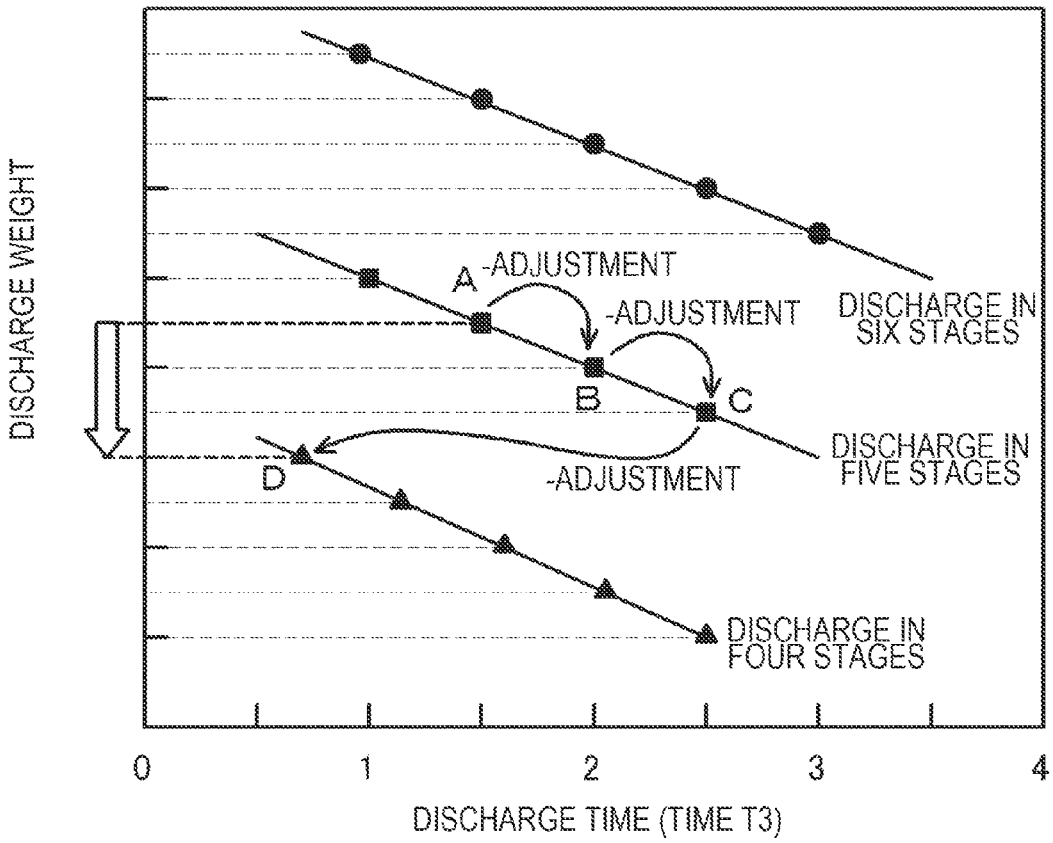
FIG. 11 is an illustration conceptually showing how the ejection amount is adjusted by the ejection nozzle drive process.

FIG. 11 is an illustration conceptually showing how the ejection amount of the ejection nozzle 100 is adjusted by carrying out the heretofore described ejection nozzle drive process. The black plots shown in the diagram represent items of drive voltage waveform data corresponding to ink ejection amounts (discharge weights). Among them, the black circle plots represent drive voltage waveform data wherein the quantity of voltage change stages during a discharge operation (the discharge stage quantity) is six, the black square plots represent drive voltage waveform data wherein the discharge stage quantity is five, and the black triangle plots represent drive voltage waveform data wherein the discharge stage quantity is four.

For example, a first item of drive voltage waveform data is data indicated as "A" in the diagram, and on an adjustment to reduce the ejection amount therefrom (a minus adjustment) being carried out, the first item switches to data indicated as "B" in the diagram. When looking at a result of a printing in accordance with the item of drive voltage waveform data, in the event that there is still a need to lighten the printing density, a minus adjustment is made again to start printing an image. By so doing, the ejection nozzle drive process shown in FIG. 9 is started, and this time, a drive voltage waveform is output using an item of drive voltage waveform data indicated as "C" in FIG. 11. In the event that there is a need to further lighten the printing density, on a minus adjustment being made again to print an image, a drive voltage waveform is output using an item of drive voltage waveform data indicated as "D" in FIG. 11.

In this way, a certain amount of adjustment is made by lengthening the discharge time (time T3) little by little while maintaining the discharge stage quantity of the drive voltage waveform, but as a result of this, on the discharge time (time T3) reaching a certain length, a further adjustment is made by making the discharge stage quantity of the drive voltage waveform smaller by one stage. In a case of an adjustment to increase the ejection amount (a plus adjustment) too, in the same way, a certain amount of adjustment is made by shortening the discharge time (time T3) little by little while maintaining the discharge stage quantity of the drive voltage waveform, but as a result of this, on the discharge time (time T3) reaching a certain length, a further adjustment is made by making the discharge stage quantity of the drive voltage waveform larger by one stage.

In this way, with the ejection nozzle drive circuit 200 of the embodiment, by changing the discharge time (time T3) of a drive voltage waveform applied to the piezoelectric element 104, and the discharge stage quantity, little by little, it is possible to adjust the ink ejection amount (discharge weight) finely, and moreover, it is possible to continuously change the ink ejection amount.

In the event of the fine adjustment, in most cases, it is possible to make the adjustment using only the discharge time (time T3) of the drive voltage waveform, and in a case of making a rough adjustment, it is sufficient to make the adjustment using the discharge stage quantity and discharge time (time T3) of the drive voltage waveform.

In the heretofore described embodiment, an example has been described as one in which the adjustment of the ink ejection amount (discharge weight) is carried out stage by stage, and consequently, the drive voltage waveform data can switch to items of data whose serial numbers are different from one another. Of course, without being limited to the step-by-step adjustment, it is also acceptable, by making an adjustment of a plurality of stages specifiable, to enable a switching to an item of drive voltage waveform data whose serial number is placed a plurality of numbers ahead in accordance with a specified content.

E. Modification Examples

Various modification examples exist in the heretofore described embodiment. Hereafter, a description will be given of the modification examples. With regard to each modification example to be described hereafter, as well as component portions similar to those of the heretofore described embodiment being given identical reference numerals and characters, a detailed description of the relevant portions will be omitted, and a description will be given centered on differences.

E-1. Second Embodiment

In the heretofore described embodiment, an example has been described as one in which whether or not to adjust the ink ejection amount (discharge weight) is specified by the operator of the inkjet printer 10, and with the ejection nozzle drive circuit 200 of the inkjet printer 10, the ink ejection amount (discharge weight) is adjusted in accordance with a specified content. However, the inkjet printer 10 itself may also acquire information relating to the necessity or otherwise of an adjustment of the ink ejection amount (discharge weight), determine whether or not the adjustment is necessary based on a result of the information, and adjust the ink ejection amount (discharge weight).

Figure 12:
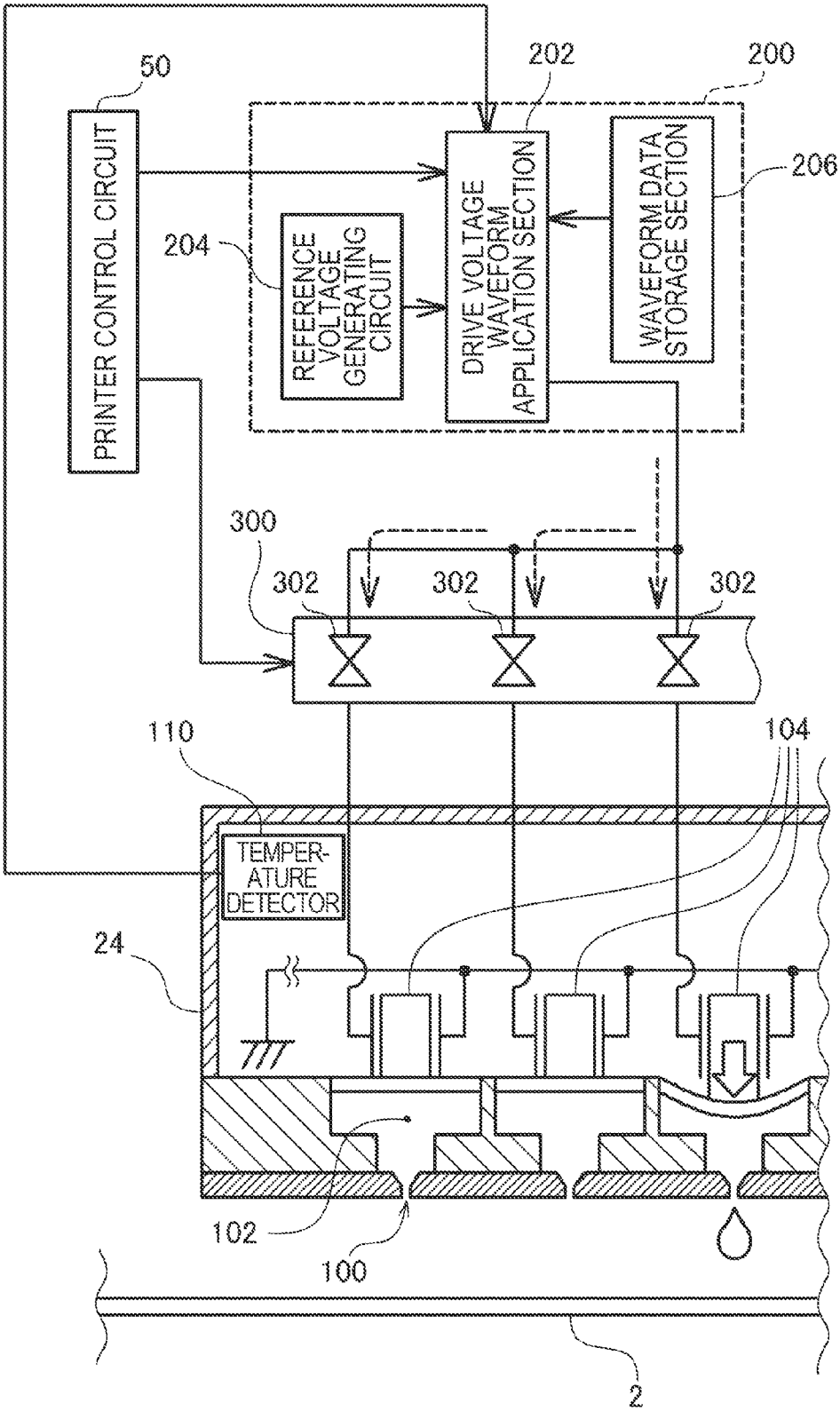
FIG. 12 is an illustration showing a configuration of an ejection head and ejection nozzle drive circuit in a second embodiment of the invention.

FIG. 12 is an illustration showing a configuration of an ejection head 24 and ejection nozzle drive circuit 200 according to a second embodiment. As shown in the diagram, in the second embodiment, a temperature detector 110 which detects an environmental temperature is mounted on one portion of the ejection head 24, and data on the environmental temperature detected by the temperature detector 110 are input into a drive voltage waveform application section 202 of the ejection nozzle drive circuit 200. For this reason, in the second embodiment, it is possible for the inkjet printer 10 to adjust the ink ejection amount (discharge weight) finely in accordance with an environmental temperature when printing an image.

Figure 13:
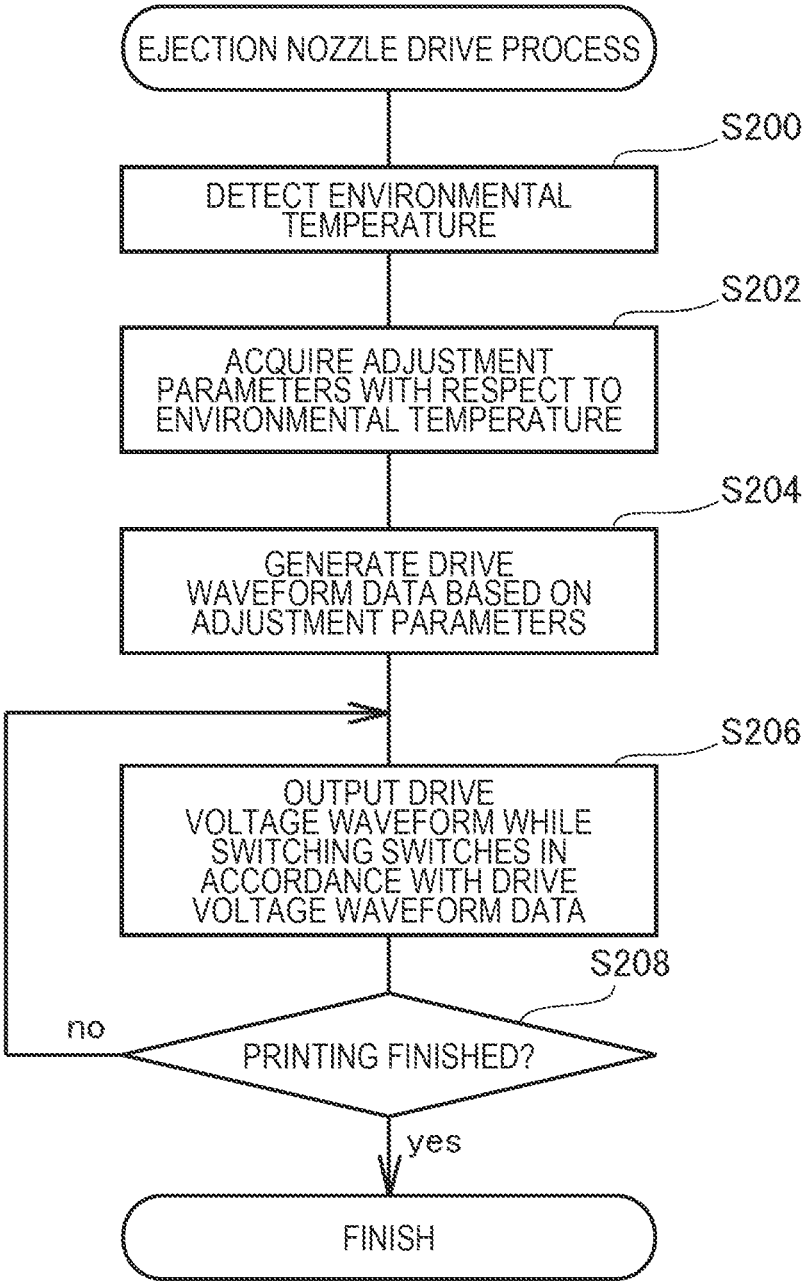
FIG. 13 is a flowchart showing an ejection nozzle drive process of the second embodiment.

FIG. 13 is a flowchart showing an ejection nozzle drive process carried out by the ejection nozzle drive circuit 200 of the second embodiment. This process is also a process which, on an instruction to start a printing being received from the printer control circuit 50, is executed by the ejection nozzle drive circuit 200, in the same way as the ejection nozzle drive process heretofore described using FIG. 9.

In the ejection nozzle drive process of the second embodiment, the process begins by detecting an environmental temperature of the inkjet printer 10 (step S200). As the temperature detector 110 which detects an environmental temperature is mounted on the ejection head 24, as heretofore described using FIG. 12, it is possible to detect an environmental temperature correlated closely with the temperature of ink ejected from an ejection nozzle 100.

Next, adjustment parameters with respect to the environmental temperature detected are acquired (step S202). Herein, the adjustment parameters are parameters used to adjust the ink ejection amount (discharge weight). In the second embodiment, the discharge stage quantity and discharge time (time T3) of a drive voltage waveform are used as the adjustment parameters, and appropriate adjustment parameters (the discharge stage quantity and discharge time T3) are stored in advance in a condition in which they are correlated with the environmental temperature.

Figure 14:
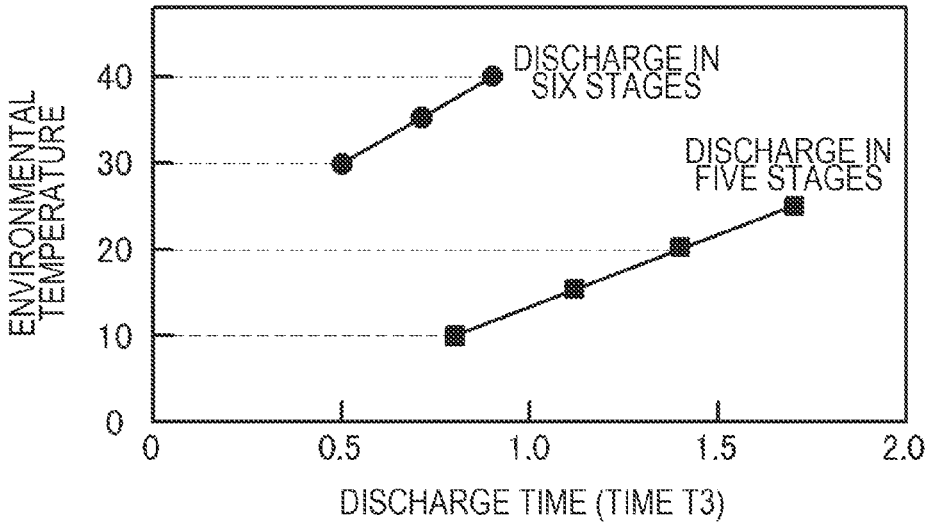
FIG. 14 is an illustration showing how adjustment parameters (a discharge stage quantity and a discharge time T3) are stored with respect to an environmental temperature.

FIG. 14 is an illustration showing how the adjustment parameters (the discharge stage quantity and discharge time T3) are stored with respect to the environmental temperature. In the example shown in the diagram, discharge stage quantities and discharge times (times T3) are set with respect to a plurality of temperatures at 5° C. intervals within an environmental temperature range of 10° C. to 40° C. Consequently, in the event that an environmental temperature has been detected, by referring to the kind of correspondence relationship shown in FIG. 14, it is possible to immediately acquire adjustment parameters (a discharge stage quantity and a discharge time T3) correlated with the environmental temperature. The kind of correspondence relationship illustrated in FIG. 14 may also be stored in the waveform data storage section 206, and may also be stored in the memory of the controller mounted on the drive voltage waveform application section 202.

After acquiring adjustment parameters in the way heretofore described, drive voltage waveform data are generated based on the adjustment parameters (step S204). That is, as heretofore described using FIGS. 10A to 10C, the drive voltage waveform data are configured of a starting point LS when the drive voltage waveform is simplified into a polygonal line form, stage quantities indicating the voltages in the positions of inflection points L0 to L5, and the times T0 to T5 of the waveform sections between the inflection points L0 to L5. Consequently, it is possible, based on the adjustment parameters acquired, to easily generate the drive voltage waveform data.

Figure 15:
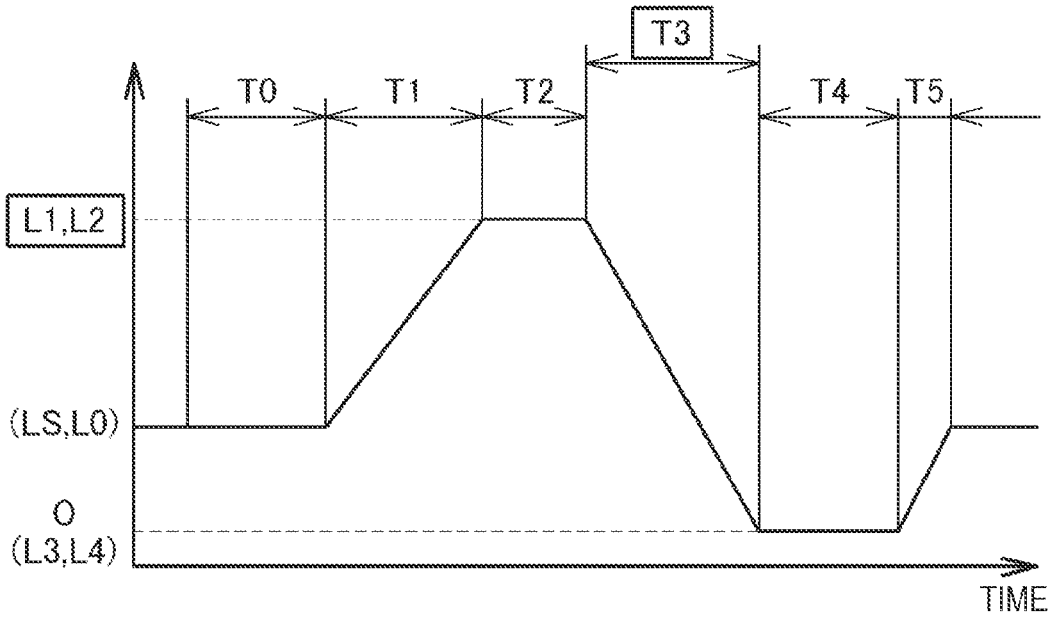
FIG. 15 is an illustration illustrating how drive voltage waveform data are generated in accordance with the adjustment parameters (discharge stage quantity and discharge time T3)

For example, as illustrated in FIG. 15, in the event of an item of drive voltage waveform data whose stage quantities at L3 and L4 are zero, simply by changing the stage quantities at L1 and L2 to discharge stage quantities obtained as adjustment parameters, and the time T3 to a discharge time obtained as an adjustment parameter, it is possible to generate drive voltage waveform data corresponding to the adjustment parameters. The process of generating drive voltage waveform data corresponding to adjustment parameters may comprise making one portion of drive voltage waveform data blank and, by incorporating adjustment parameters therein, generating drive voltage waveform data, but can also be taken as a process of changing preset standard drive voltage waveform data by means of adjustment parameters.

After generating drive voltage waveform data corresponding to adjustment parameters in this way, a drive voltage waveform is output by switching the switches S0 to S6 in accordance with the drive voltage waveform data generated (step S206). After outputting the drive voltage waveform, it is determined whether or not a printing has finished (step S208). Whether or not the printing has finished can be immediately determined depending on whether or not an instruction from the printer control circuit 50 has been received. If the printing is not yet finished (step S208: no), after outputting a drive voltage waveform again based on the drive voltage waveform data (step S206), it is determined whether or not the printing has completed (step S208).

The ejection nozzle drive circuit 200 repeats this kind of process until it receives an instruction to finish the printing from the printer control circuit 50 and, if it is determined that the printing has finished (step S208: yes), finishes the ejection nozzle drive process of the second embodiment.

In the heretofore described second embodiment, it is possible to detect an environmental temperature of the inkjet printer 10, generate drive voltage waveform data in accordance with the environmental temperature, and drive the ejection nozzle 100. For this reason, even in the event that the viscosity of ink changes due to a change in environmental temperature, as it is possible to counteract the effect thereof by changing the drive voltage waveform data, it is possible to constantly print an image at a stable quality without having the effect of an environmental temperature fluctuation.

In the heretofore described second embodiment, as shown in FIG. 14, an example has been described as one in which adjustment parameters are determined on an environmental temperature being fixed, and as a result of this, drive voltage waveform data are generated. Consequently, a one-to-one relationship is established between an environmental temperature and drive voltage waveform data. However, drive voltage waveform data may also be corrected using an environmental temperature. For example, as shown in FIGS. 10A to 10C, a plurality of items of drive voltage waveform data are stored with serial numbers. In the event that an environmental temperature is high, as the viscosity of ink decreases, and the ejection amount of ink becomes larger, an item of drive voltage waveform data which is one serial number smaller (smaller in ejection amount) is selected. Conversely, in the event that an environmental temperature is low, as the viscosity of ink increases, and the ejection amount of ink becomes smaller, an item of drive voltage waveform data which is one serial number larger (larger in ejection amount) is selected.

Of course, in the event that an environmental temperature is very high, or in the event that an environmental temperature is very low, an item of drive voltage waveform data which is two serial numbers smaller, or an item of drive voltage waveform data which is two serial numbers larger, may also be selected. By so doing, once a preferable printing density is set, it is possible, without having the effect of an environmental temperature after that, to constantly print an image at the preferable printing density.

E-2. Third Embodiment

In the heretofore described first embodiment and second embodiment, an example has been described as one in which the ink ejection amount (discharge weight) is adjusted using only the discharge time (time T3), apart from the discharge stage quantity. However, actually, it is possible to adjust the ink ejection amount (discharge weight) by changing a time other than the discharge time (time T3).

Figure 16:
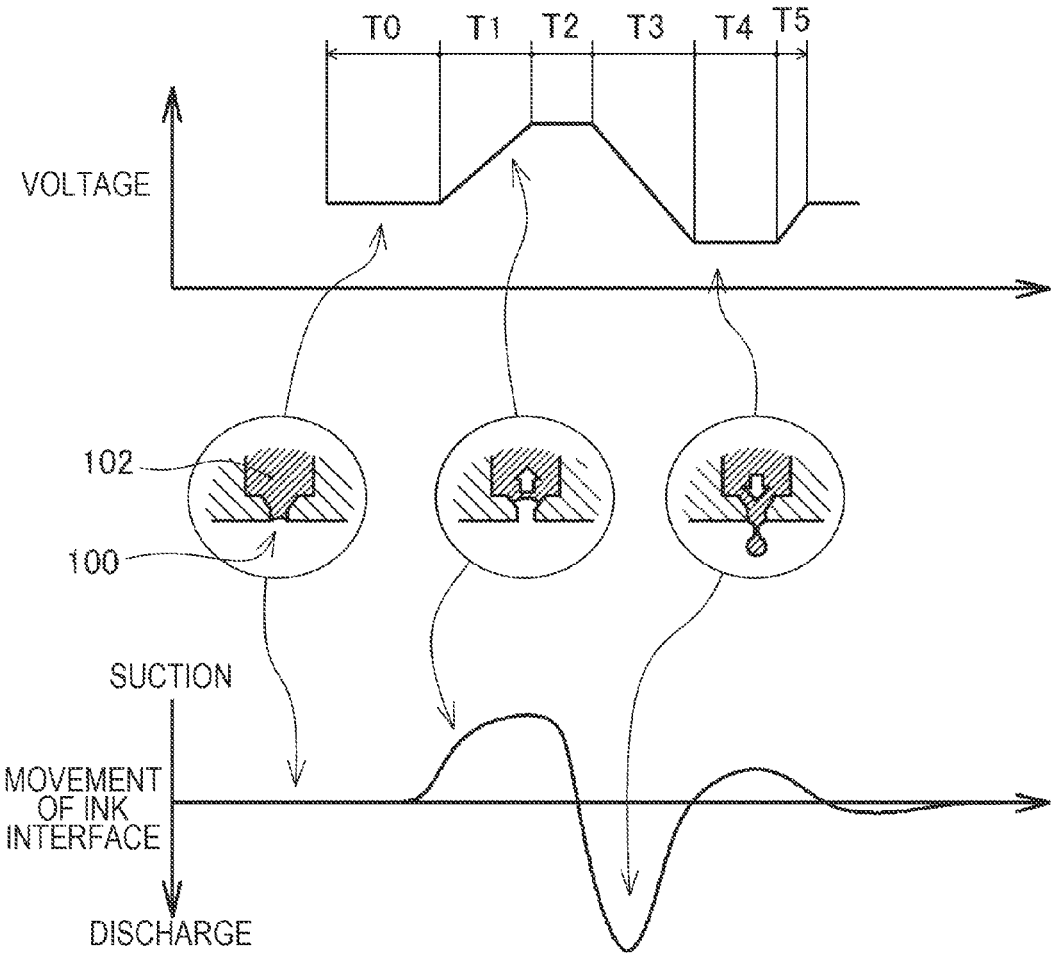
FIG. 16 is an illustration showing a movement of the ink interface of the ejection nozzle due to the drive voltage waveform applied to the piezoelectric element.

FIG. 16 is an illustration showing a movement of the ink interface of an ejection nozzle 100 by a drive voltage waveform being applied to the piezoelectric element 104 of the ejection nozzle 100. A drive voltage waveform is shown in the upper portion of the diagram, and an ink interface formed in the ejection nozzle 100 and a movement of ink in the ink chamber 102 are conceptually shown in the middle portion of the diagram. How the ink interface varies as time passes is shown in the lower portion of the diagram.

Firstly, in a waveform section (the waveform section of the time T0) in which the drive voltage waveform is held at the initial voltage, as shown at the left end of the middle portion of FIG. 16, an ink interface is formed in the vicinity of the orifice of the ejection nozzle 100. On the voltage of the drive voltage waveform increasing from this condition, the piezoelectric element 104 deforms, and the internal volume of the ink chamber 102 increases.

As a result, ink from the ink cartridge 26 is suctioned into the ink chamber 102, and at the same time, ink in the vicinity of the orifice of the ejection nozzle 100 is also suctioned, along with which the ink interface is drawn inward (as shown in the center of the middle portion of FIG. 16). This kind of movement of ink settles gradually while a maximum voltage is being held, and after the maximum voltage has been held for the time T2, this time, the voltage is decreased. By so doing, the piezoelectric element 104 deforms in a direction in which it reduces the internal volume of the ink chamber 102, and the ink in the ink chamber 102 is discharged in such a way as to be pushed out from the orifice of the ejection nozzle 100 (as shown at the right end of the middle portion of FIG. 16).

After the ink has been discharged in this way, the voltage of the drive voltage waveform returns to the initial voltage after it has been held at the minimum voltage for the time T4. As the ink interface temporarily comes into a condition in which it bulges out largely when the ink is discharged, the ink interface tends to return to the original position after that, and a kind of resonance phenomenon occurs due to this force. As a result of this, while the voltage of the drive voltage waveform is being held, or even after it has returned to the initial voltage, the amplitude of vibration of the ink interface decreases gradually while the ink interface is vibrating at a constant frequency.

After the drive voltage waveform has increased, in a waveform section (the waveform section of the time T2) in which the maximum voltage is held, the same ink vibration phenomenon occurs in the vicinity of the orifice of the ejection nozzle 100. That is, the ink in the vicinity of the orifice of the ejection nozzle 100 flows inward while the drive voltage waveform is increasing, and the piezoelectric element 104 is carrying out a suction operation (the waveform section of the time T1), and still tends to flow inward due to the inertia of the ink for a while even immediately after the drive voltage has been held at a constant voltage to stop the suction operation. However, as the suction operation of the piezoelectric element 104 has finished, the flow of the ink tending to flow inward attenuates quickly, and this time, the ink tends to flow toward the vicinity of the orifice of the ejection nozzle 100 due to the action of a force pushing back the ink in an opposite direction. Consequently, in the waveform section (the waveform section of the time T2) in which the drive voltage waveform has finished increasing, and is held at the maximum voltage, at first, the ink in the vicinity of the orifice of the ejection nozzle 100 is flowing inward, but after a while, starts flowing outward (that is, in the direction of the orifice).

In the event that a suction operation is carried out in the condition in which the ink in the vicinity of the orifice of the ejection nozzle 100 is flowing inward, it is considered that the amount of ink discharged decreases, and conversely, in the event that a suction operation is carried out in the condition in which the ink is flowing outward, it is considered that the amount of ink discharged increases.

When the ink ejection amount (discharge weight) is measured during the time (the time T2) for which the drive voltage waveform is held at the maximum voltage is changed, it can be confirmed that the ink ejection amount (discharge weight) increases gradually as the time T2 is lengthened, and decreases after having eventually reached a maximum ejection amount. This is because, in the case in which the time T2 is extremely short, as it happens that the piezoelectric element 104 tends to push out the ink against the inward flow of ink, the ink ejection amount (discharge weight) decreases. Since the inward flow of ink weakens as the time T2 becomes longer, the ink ejection amount (discharge weight) increases, and in the event that the time T2 is further lengthened, the condition in which the ink in the vicinity of the orifice of the ejection nozzle 100 is flowing outward (in the direction of the orifice), a discharge operation is carried out in such a way as to push out the ink from behind, the ink ejection amount (discharge weight) further increases. However, in the event that the time T2 is made too long, as it happens that the outward flow of the ink in the vicinity of the orifice also attenuates, or that the ink flows inward again, the ink ejection amount (discharge weight) decreases.

As is obvious from the above description, it is also possible to adjust the ink ejection amount (discharge weight) by changing the time (time T2) for which the drive voltage waveform is held at the maximum voltage. Heretofore, a description has been given of the case of changing the time T2, but it is conceivable that, by also changing another time, it is possible to adjust the ink ejection amount (discharge weight). That is, a mechanism of adjusting the ink ejection amount (discharge weight) by changing the time T2 lies in changing the ejection amount (discharge weight) utilizing the flow of ink in the ink chamber 102 (at least in the vicinity of the orifice of the ejection nozzle 100). For example, in the event that the ink in the vicinity of the orifice of the ejection nozzle 100 flows inward, the flow of the ink acts in a direction in which it counteracts a discharge operation of the piezoelectric element 104, and in the event that the ink flows outward, the flow of the ink acts in a direction in which it accelerates a discharge operation of the piezoelectric element 104. The extent of their effects depends on the intensity of ink flow.

In the heretofore described second embodiment, the direction and intensity of an ink flow at a point at which the piezoelectric element 104 starts a discharge operation are adjusted by changing the time T2, as a result of which the ink ejection amount (discharge weight) is changed. Consequently, when it is possible to affect the flow of ink in the ink chamber 102 (at least in the vicinity of the orifice of the ejection nozzle 100), it is possible to change not only the time T2, but the ink ejection amount (discharge weight) on the same principle.

For example, the length of a time (the time T1) for which the piezoelectric element 104 carries out a suction operation directly affects the intensity of an inward ink flow caused by the suction operation. Naturally, the effect also reaches the waveform section (the waveform section of the time T2) in which the drive voltage waveform is held. Consequently, by also changing the length of the time T1, it is possible to change the ink ejection amount (discharge weight).

As shown in FIG. 16, even after the drive voltage waveform has finished being output (the time T5 has elapsed), the ink in the vicinity of the orifice of the ejection nozzle 100 is vibrating at an approximately constant frequency. Since this vibration also attenuates as time passes, in the event that the time T0 is set to a sufficiently long time, the effect of the vibration can be almost ignored, but in the event that the time T0 is set to be shorter, it may affects a subsequent suction operation.

For example, on the piezoelectric element 104 starting a suction operation when ink is flowing toward the orifice of the ejection nozzle 100, the ink flow acts in a direction in which it counteracts the suction operation, and conversely, when the ink is flowing inward, the ink flow acts in a direction in which it accelerates the suction operation.

The effect thereof also reaches the waveform section (the waveform section of the time T2) in which the drive voltage waveform is held after the suction operation. Consequently, as long as the time T0 is not set to a length such that it is possible to ignore the effect of the previous drive voltage waveform, it is also possible to adjust the ink ejection amount (discharge weight) by setting the time T0. Furthermore, the amplitude of vibration of ink occurring after the piezoelectric element 104 has finished the discharge operation is considered to change by setting the time T4 and time T5. Consequently, it is also possible to adjust the ink ejection amount (discharge weight) by changing the amplitude of vibration persisting during a next suction operation by means of the setting of the time T4 and time T5.

E-3. Fourth Embodiment

In the case of adjusting the ink ejection amount (discharge weight) by changing the discharge time (time T3), as in the heretofore described first embodiment or second embodiment, the ejection speed of ink (the speed of ink ejected from an ejection nozzle 100) also changes. With the inkjet printer 10, as a change in the ink ejection speed may affect an image quality, it is also acceptable to adopt a configuration such as to counteract the effect of the ink ejection speed by also changing the time T0, in conjunction with the change of the time T3.

With the inkjet printer 10, it is for the following reason that a change in the ink ejection speed may affect an image quality. Firstly, as heretofore described using FIG. 1, the inkjet printer 10 ejects ink from the ejection nozzles 100 while reciprocating the ejection head 24 in relation to the printing medium 2, thus printing an image. As it is not possible to print an image when the ejection nozzles 100 provided in the ejection head 24 and the printing medium 2 come into contact, a gap called a platen gap is provided between the ejection nozzles 100 and printing medium 2, and ink ejected from the ejection nozzles 100, after flying across the platen gap, reaches a surface of the printing medium 2. As the ejection head 24 ejects ink while reciprocating in relation to the printing medium 2, ink ejected from the ejection nozzles 100 flies obliquely toward the surface of the printing medium 2 across the platen gap. In other words, it means that a slight positional misalignment occurs between a position toward which the ejection nozzles 100 eject ink and a position on the printing medium 2 which the ejected ink reaches. The size of the positional misalignment depends on the ink ejection speed.

That is, in the event that the ink ejection speed becomes higher, as ink flies across the platen gap in a shorter time after the ink is ejected, the positional misalignment becomes smaller. Conversely, in the event that the ink ejection speed becomes lower, as it takes more time from ink being ejected until the ink reaches the surface of the printing medium 2, the positional misalignment becomes larger. For this kind of reason, on the ink ejection speed changing, the size of positional misalignment also changes, thus affecting an image quality.

Therein, in a case of shortening the discharge time (time T3) in order to adjust the ink ejection amount (discharge weight), as the ink ejection speed is considered to become higher, the time T0 is lengthened. By so doing, it is possible to suppress a change in positional misalignment by delaying an ink ejection timing by an amount by which the time of flight across the platen gap has been shortened. Conversely, in a case of lengthening the discharge time (time T3) in order to adjust the ink ejection amount (discharge weight), the time T0 is shortened. By so doing, it is possible to suppress a change in position gap by ejecting ink at an earlier timing by an amount by which the time of flight across the platen gap has been lengthened.

Figure 17A:
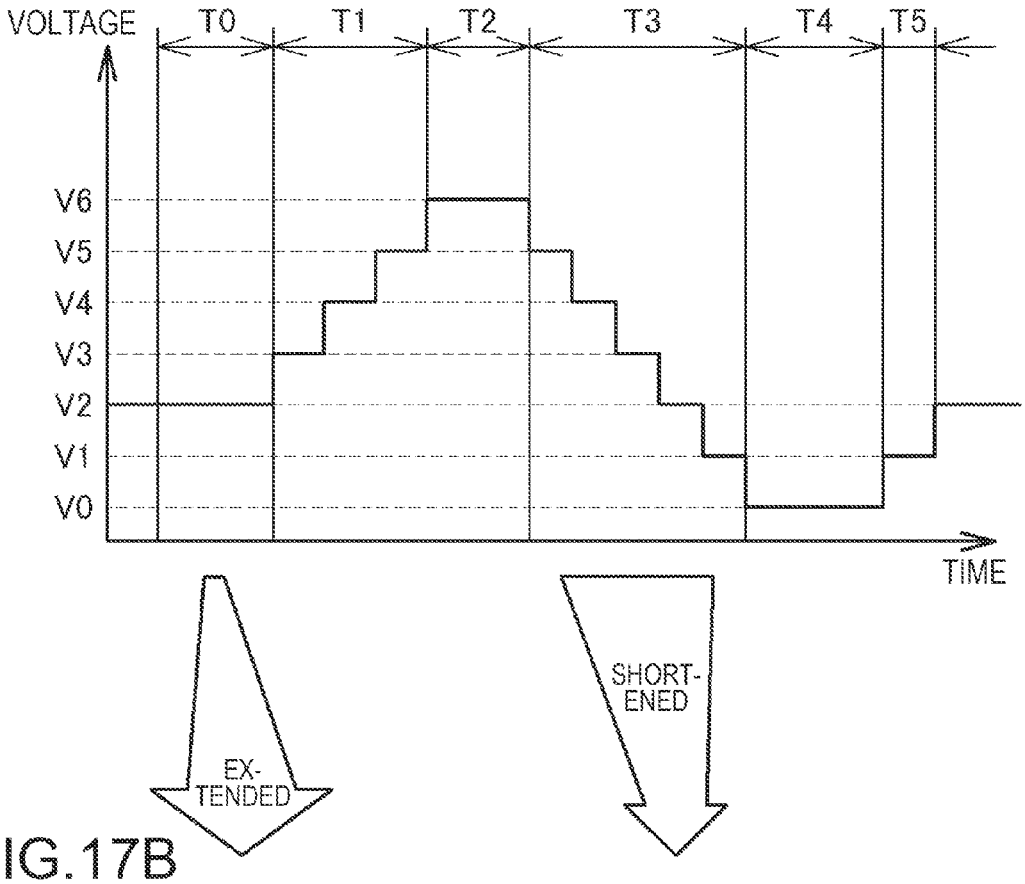
FIGS. 17A and 17B are illustrations showing a method of avoiding a deterioration in image quality due to the fact that the discharge time (time T3) of ink has been changed.
Figure 17B:
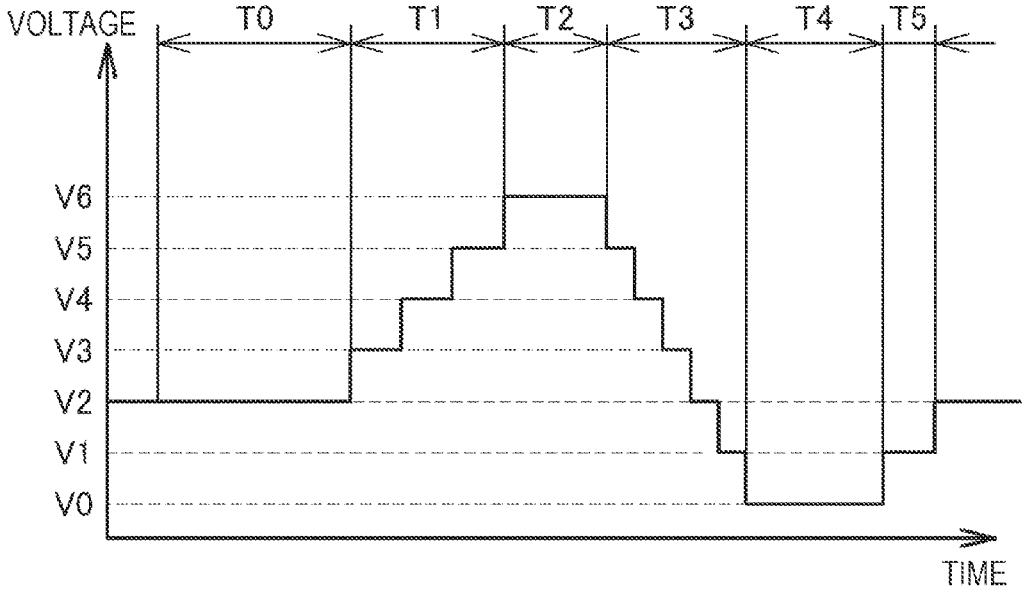

FIGS. 17A and 17B illustrate how the time T0 is extended in order to avoid a deterioration in image quality due to the fact that the ink ejection time (time T3) has been shortened.

E-4. Fifth Embodiment

In the heretofore described embodiment and various modification examples, an example has been described as one in which one drive voltage waveform is repeatedly output. However, the invention can also be suitably applied to a case in which a plurality of drive voltage waveforms are made into a set, and the set of drive voltage waveforms is repeatedly output.

Figure 18:
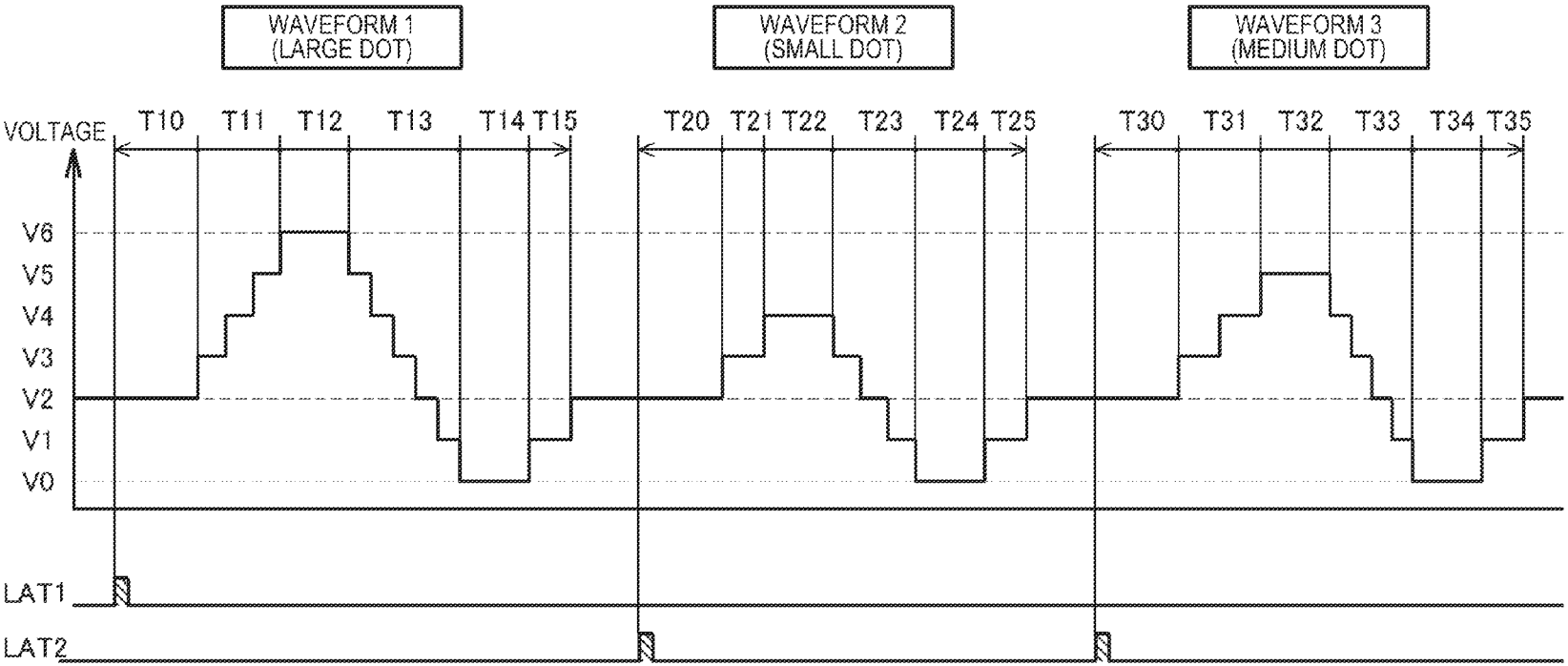
FIG. 18 is an illustration illustrating a case of outputting a plurality of drive voltage waveforms in a set.

FIG. 18 is an illustration illustrating a case in which a plurality of drive voltage waveforms are output in a set. In the example shown in the diagram, one waveform set is configured of three waveforms, a drive voltage waveform (a waveform 1) for forming a large ink dot (a large dot), a drive voltage waveform (a waveform 2) for forming a small ink dot (a small dot), and a drive voltage waveform (a waveform 3) for forming a medium ink dot (a medium dot). It being taken that the waveform set starts to be output at the timing of a latch signal LAT1, first of all, the waveform 1 is output, and then, on a latch signal LAT2 being received, the waveform 2 is output, and on the latch signal LAT2 being received again, the waveform 3 is output.

In the case in which the plurality of drive voltage waveforms are made into a set in this way, it is difficult to adjust the ink ejection amount (discharge weight) by changing the amount of voltage change (the amount of deformation of a piezoelectric element 104) during a discharge operation. For example, a case will be considered in which the size of the small dot is made slightly smaller (the ejection amount is made smaller). As an ink discharge operation for the small dot is carried out by decreasing the drive voltage from the voltage V4 to the voltage V0 in the waveform 2, by slightly decreasing the voltage V4, or by slightly increasing the voltage V0, it is possible to reduce the ink ejection amount (discharge weight), and make the size of dots smaller. However, as the voltage V5 is generated by adding the inter-terminal voltage of the capacitor C5 to the voltage V4, and the voltage V6 is generated by adding the inter-terminal voltage of the capacitor C5 and the inter-terminal voltage of the capacitor C6 to the voltage V4, as heretofore described using FIG. 3, when the voltage V4 is decreased, the voltage V5 and voltage V6 also decrease in the same way. For this reason, when the small dot formed by the waveform 2 is made smaller (the ink ejection amount is slightly decreased), the large dot formed by the waveform 1 and the medium dot formed by the waveform 3 also become smaller (the ink ejection amount becomes smaller). Alternatively, in the case too in which the voltage V0 is made slightly higher, the small dot becomes smaller, and at the same time, the large dot and medium dot also become smaller. In this way, when the values of the reference voltages of the voltage V0 to the voltage V6 are changed in order to adjust the ink ejection amount of one waveform included in the waveform set, the ejection amounts of the other waveforms included in the waveform set also change.

In the event that the ink ejection amount is adjusted using the discharge time (time T3) or another waveform section time (time T2 or the like) of a drive voltage waveform, it becomes possible to adjust only the ejection amount of a single waveform in the waveform set. For example, in the example shown in FIG. 18, in the event that a discharge time (a time T13) of the waveform 1 is changed, it is possible to adjust only the ink ejection amount for the large dot, thus having no effect on the ink ejection amount for the small dot or medium dot. As the waveform 2 for the small dot starts to be output by the first latch signal LAT2, and the waveform 3 for the medium dot starts to be output by the second latch signal LAT2, as heretofore described, even in the event that the discharge time (time T13) of the waveform 1 is changed, it does not happen either that timings of starting to output the waveform 2 and waveform 3 fluctuate due to the effect thereof. In this way, in the event that a time of a waveform section configuring a drive voltage waveform is changed, as it is possible to freely adjust only the amount of ink ejected by any waveform, it is possible to print a high quality image.

E-5. Sixth Embodiment

In the ejection nozzle drive circuit 200 of each of the heretofore described embodiment and various modification examples, as shown in FIG. 3, the capacitors C1 to C6 are mutually connected in series, and an example has been described as one in which the voltage between which capacitors is connected to a piezoelectric element 104 switches depending on the connection condition of the switches S0 to S6. However, in the event that it is possible to generate a preset plurality of reference voltages, the invention is not limited to this kind of circuit configuration. For example, as shown below, a plurality of capacitors are connected in parallel, and after the capacitors are charged by connecting them to a power supply, the connection between the capacitors switches to a series connection, and an applied voltage is generated. At this time, it is also acceptable to adopt a configuration such as to generate a plurality of reference voltages by making the number of capacitors to be switched to a series connection different.

Figure 19:
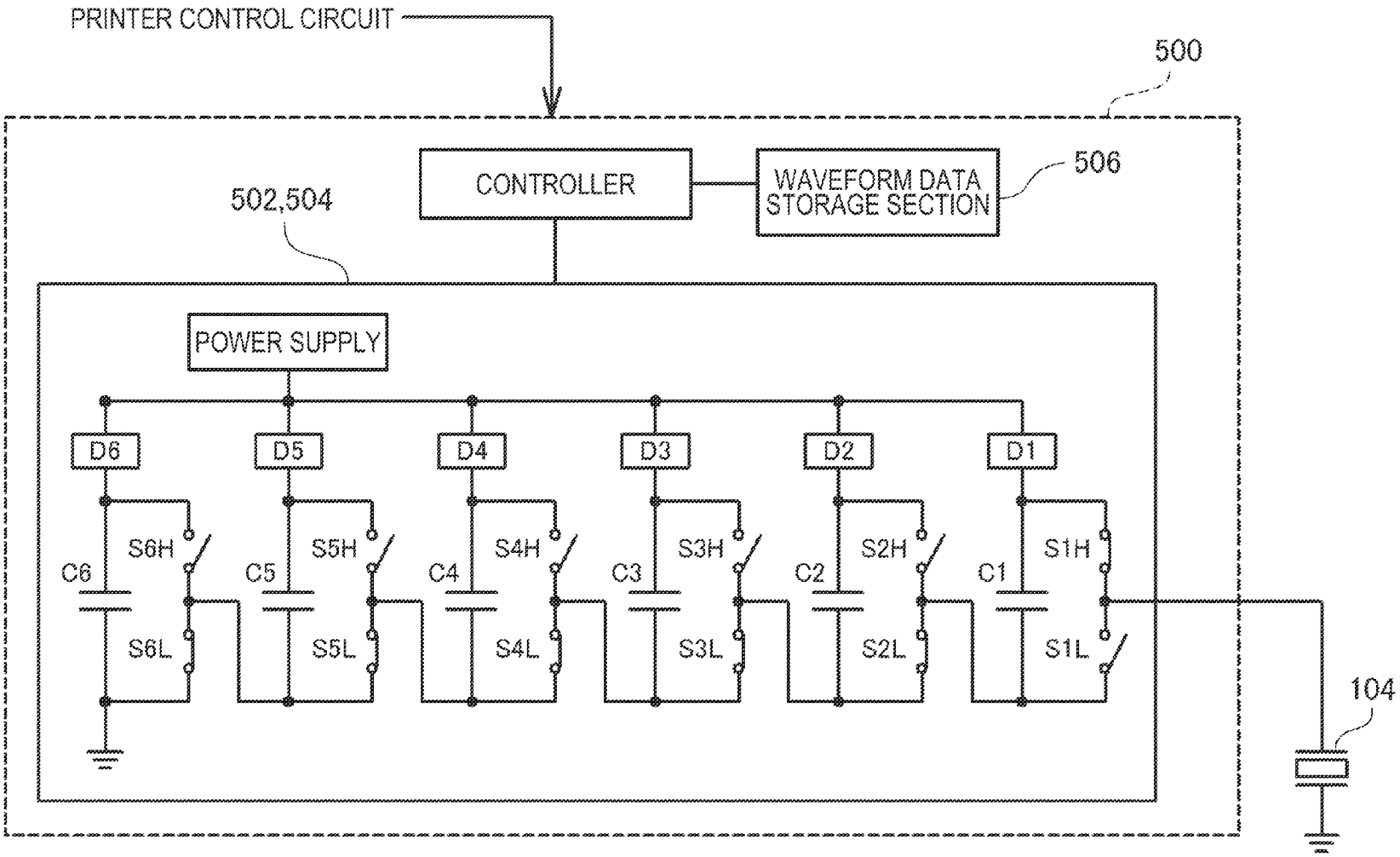
FIG. 19 is an illustration showing a configuration of an ejection nozzle drive circuit in a fourth embodiment of the invention.

FIG. 19 is an illustration showing a configuration of an ejection nozzle drive circuit 500 in a sixth embodiment. In the example shown in the diagram, a plurality of capacitors C1 to C6 are connected to a power supply via backflow prevention diodes D1 to D6. A switch pair configured by two switches being connected in series is connected to each capacitor C1 to C6 in parallel therewith. Furthermore, a terminal of each capacitor on a side on which it is not connected to the power supply (hereafter called a low potential side) is connected between the two switches of the switch pair provided in another capacitor. As well as the side of each capacitor on which it is not connected to the power supply being called the low potential side, a side of each capacitor on which it is connected to the power supply is called a high potential side. With this kind of configuration, the capacitors C1 to C6, as they are connected to the power supply via the backflow prevention diodes D1 to D6 respectively, are charged by a constant voltage. By switching the connection condition of the two switches of the switch pair provided in each capacitor C1 to C6 from this condition, it is possible to switch the connection condition between the capacitors C1 to C6, and generate a plurality of reference voltages.

Figure 20A:
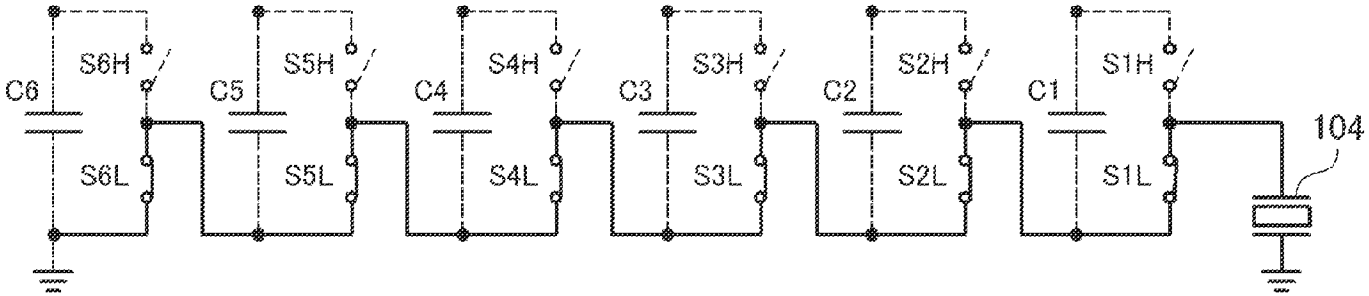
FIGS. 20A to 20C are illustrations showing how the ejection nozzle drive circuit of the fourth embodiment generates a plurality of reference voltages by switching the connection condition between capacitors.
Figure 20B:
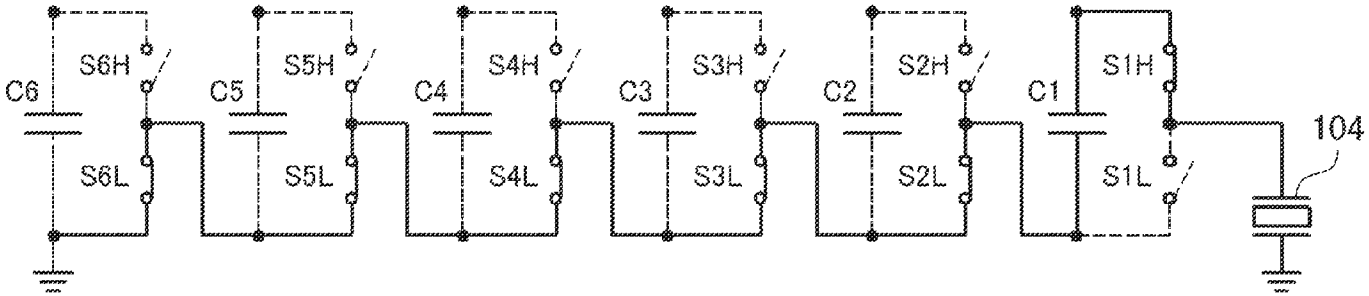
Figure 20C:
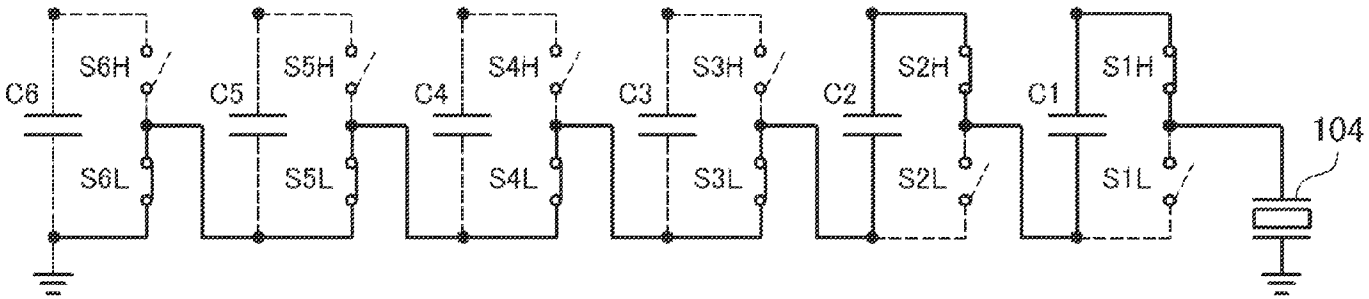

FIGS. 20A to 20C are illustrations showing how the ejection nozzle drive circuit 500 of the sixth embodiment switches the connection condition between the capacitors C1 to C6, and generates a plurality of reference voltages. As shown in FIG. 20A, with regard to the switch pair provided in each capacitor C1 to C6, when the switch on the high potential side is turned off, and the switch on the low potential side is turned on, a condition is attained in which no capacitor inter-terminal voltage is applied to the piezoelectric element 104. This condition is a condition in which the reference voltage V0 is applied.

Next, as shown in FIG. 20B, only with regard to the switch pair provided in the capacitor C1, when the switch on the high potential side is turned on, and the switch on the low potential side is turned off, a condition is attained in which the inter-terminal voltage (equivalent to the reference voltage V1) of the capacitor C1 is applied to the piezoelectric element 104.

Furthermore, as shown in FIG. 20C, with regard to the switch pair provided in the capacitor C1 and the switch pair provided in the capacitor C2, when the switch on the high potential side is turned on, and the switch on the low potential side is turned off, a condition is attained in which an inter-terminal voltage (equivalent to the reference voltage V2) obtained by connecting the capacitor C1 and capacitor C2 in series is applied to the piezoelectric element 104.

In this way, with the ejection nozzle drive circuit 500 of the sixth embodiment shown in FIG. 19, when the switch on the high potential side, of the two switches included in the switch pair, is turned on, and the switch on the low potential side is turned off, a capacitor of the switch pair is selected, and the inter-terminal voltage of the capacitor selected is applied to the piezoelectric element 104. At this time, in the event that a plurality of capacitors are selected, the capacitors attain a condition in which they are connected in series, and a voltage which is the sum of their inter-terminal voltages is applied to the piezoelectric element 104.

With the ejection nozzle drive circuit 500 of the sixth embodiment having the heretofore described configuration, drive voltage waveform data are stored in a waveform data storage section 506, and by changing a time of a waveform section configuring a drive voltage waveform, it is possible to adjust the ink ejection amount (discharge weight) finely.

Heretofore, a description has been given of the embodiment and various modification examples of the invention, but the invention is not limited to these descriptions and can be implemented in various forms without departing from the scope thereof. For example, it is possible to configure an ejection nozzle drive circuit using an electrical accumulator (for example, a secondary battery) which can accumulate an electric charge, in place of a capacitor.

In the heretofore described embodiment or various modification examples, an example has been described as one in which the liquid ejection apparatus is the inkjet printer 10 which ejects ink. However, the invention can also be suitably applied to a liquid ejection apparatus acting as a surgical instrument with which body tissue is incised or excised by ejecting a liquid, such as water or salt water, in a pulsed form.

What is claimed is:

1. A liquid ejection apparatus which, by applying a drive voltage waveform to a piezoelectric element which when deformed ejects a liquid from an ejection nozzle, the liquid ejection apparatus comprising:

a reference voltage generating unit which generates a plurality of reference voltages;

a drive voltage waveform data storage unit which, by classifying the drive voltage waveform into waveform sections including a voltage increasing section, decreasing section, or holding section, stores drive voltage waveform data including a required time of each waveform section, and a voltage selected from the plurality of reference voltages for each boundary position of each waveform section, wherein at least two different reference waveform voltages of the plurality of reference voltages are used as stages in the voltage increasing section and wherein at least two different waveform voltages of the plurality of reference voltages are used as stages in the voltage decreasing section;

a drive voltage waveform application unit which, in accordance with information relating to an adjustment of the ejection amount of the liquid ejected from the ejection nozzle, changes the required time included in the drive voltage waveform data, and applies the drive voltage waveform to the piezoelectric element, wherein the drive voltage waveform application unit adjusts the ejection amount in relatively small increments using only the required time, and adjusts the ejection amount in relatively large increments using the required time and the voltage.

2. The liquid ejection apparatus according to claim 1, comprising:

a temperature detection unit which detects an environmental temperature at which the ejection nozzle operates, wherein the information relating to the adjustment of the liquid ejection amount is the environmental temperature.

3. The liquid ejection apparatus according to claim 1, wherein the drive voltage waveform application unit is a unit which applies the drive voltage waveform by making the start of application of the drive voltage waveform different in accordance with the required time included in the drive voltage waveform data.

4. The liquid ejection apparatus of claim 1, wherein the drive voltage waveform data corresponds to a plurality of ejection amounts which are organized in a predetermined order according to a desired discharge weight, and wherein if it is determined that the ejection amount is to be increased, the drive voltage waveform application unit changes an original drive voltage waveform data corresponding to a first discharged weight to a subsequent drive voltage waveform in the predetermined order which is associated with an increased discharge weight, and wherein if it is determined that the ejection amount is to be reduced, the drive voltage waveform application unit changes the original drive voltage waveform corresponding to the first discharged weight to a previous drive voltage waveform in the predetermined order which is associated with a decreased discharge weight.

5. A liquid ejection apparatus which, by applying a drive voltage waveform to a piezoelectric element which drives an ejection nozzle, ejects a liquid from the ejection nozzle, comprising:

a voltage generating unit which generates a first voltage and a second voltage higher than the first voltage;

a drive voltage waveform data storage unit which, by classifying the drive voltage waveform into waveform sections including a voltage increasing section, decreasing section, or holding section, stores drive voltage waveform data including a required time of each waveform section configuring the drive voltage waveform, and a voltage selected from the first and second voltages for each boundary position of each waveform section, wherein the first voltage and second voltage are both used as stages in the voltage increasing section and also as stages in the voltage decreasing section;

a drive voltage waveform application unit which, in accordance with information relating to an adjustment of the ejection amount of the liquid ejected from the ejection nozzle, changes the required time included in the drive voltage waveform data, and applies the drive voltage waveform to the piezoelectric element, wherein the drive voltage waveform application unit adjusts the ejection amount in relatively small increments using only the required time, and adjusts the ejection amount in relatively large increments using the required time and the voltage.

6. The liquid ejection apparatus of claim 5, wherein the drive voltage waveform data corresponds to a plurality of ejection amounts which are organized in a predetermined order according to a desired discharge weight, and wherein if it is determined that the ejection amount is to be increased, the drive voltage waveform application unit changes an original drive voltage waveform data corresponding to a first discharged weight to a subsequent drive voltage waveform in the predetermined order which is associated with an increased discharge weight, and wherein if it is determined that the ejection amount is to be reduced, the drive voltage waveform application unit changes the original drive voltage waveform corresponding to the first discharged weight to a previous drive voltage waveform in the predetermined order which is associated with a decreased discharge weight.

7. A liquid ejection apparatus which, by applying a drive voltage waveform to a piezoelectric element which drives an ejection nozzle, ejects a liquid from the ejection nozzle, the liquid ejection apparatus comprising:

a reference voltage generating unit which generates a plurality of reference voltages;

a drive voltage waveform data storage unit which, by classifying the drive voltage waveform into waveform sections including a voltage increasing section, decreasing section, or holding section, stores drive voltage waveform data including a required time of each waveform section, a first boundary voltage and a second boundary voltage selected from the plurality of reference voltages for a starting and ending voltage of each waveform section, wherein at least two different reference waveform voltages of the plurality of reference voltages are used as stages in the voltage increasing section and wherein at least two different waveform voltages of the plurality of reference voltages are used as stages in the voltage decreasing section;

a drive voltage waveform application unit which, in accordance with information relating to an adjustment of the ejection amount of the liquid ejected from the ejection nozzle, changes the required time included in the drive voltage waveform data, and applies the drive voltage waveform to the piezoelectric element, wherein the drive voltage waveform application unit adjusts the ejection amount in relatively small increments using only the required time, and adjusts the ejection amount in relatively large increments using the required time and the voltage.

8. The liquid ejection apparatus according to claim 7, comprising:

a temperature detection unit which detects an environmental temperature at which the ejection nozzle operates, wherein the information relating to the adjustment of the liquid ejection amount is the environmental temperature.

9. The liquid ejection apparatus according to claim 7, wherein the drive voltage waveform application unit is a unit which applies the drive voltage waveform by making the start of application of the drive voltage waveform different in accordance with the required time included in the drive voltage waveform data.

10. The liquid ejection apparatus according to claim 7, wherein the drive voltage waveform data corresponds to a plurality of ejection amounts which are organized in a predetermined order according to a desired discharge weight, and wherein if it is determined that the ejection amount is to be increased, the drive voltage waveform application unit changes an original drive voltage waveform data corresponding to a first discharged weight to a subsequent drive voltage waveform in the predetermined order which is associated with an increased discharge weight, and wherein if it is determined that the ejection amount is to be reduced, the drive voltage waveform application unit changes the original drive voltage waveform corresponding to the first discharged weight to a previous drive voltage waveform in the predetermined order which is associated with a decreased discharge weight.

* * * * *